US011072189B2

(12) United States Patent
Miyamoto et al.

(10) Patent No.: US 11,072,189 B2
(45) Date of Patent: Jul. 27, 2021

(54) MEDIUM DISCHARGING APPARATUS AND MEDIUM PROCESSING APPARATUS

(71) Applicant: SEIKO EPSON CORPORATION, Tokyo (JP)

(72) Inventors: Yuji Miyamoto, Shiojiri (JP); Masaki Shimomura, Matsumoto (JP); Akira Nakazawa, Azumino (JP); Toshihiro Imae, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/673,332

(22) Filed: Nov. 4, 2019

(65) Prior Publication Data

US 2020/0139730 A1 May 7, 2020

(30) Foreign Application Priority Data

Nov. 5, 2018 (JP) ..... JP2018-208291
Jan. 24, 2019 (JP) ..... JP2019-010028

(51) Int. Cl.
*B41J 11/00* (2006.01)

(52) U.S. Cl.
CPC ..... *B41J 11/0045* (2013.01)

(58) Field of Classification Search
CPC ..... B41J 11/0045; B65H 2511/11; B65H 2511/20; B65H 2801/06; B65H 2405/11164; B65H 2407/20; B65H 2402/64; B65H 43/00; B65H 31/02; B65H 31/20
See application file for complete search history.

(56) References Cited

U.S. PATENT DOCUMENTS

2007/0075477 A1* 4/2007 Shiohara ..... B65H 1/28 271/9.08
2013/0257960 A1 10/2013 Nakano et al.

FOREIGN PATENT DOCUMENTS

| | | | |
|---|---|---|---|
| JP | S57-077159 | A | 5/1982 |
| JP | S58-111475 | A | 7/1983 |
| JP | H02-267567 | A | 11/1990 |
| JP | H03-279158 | A | 12/1991 |
| JP | 2003-095515 | A | 4/2003 |
| JP | 2013-209180 | A | 10/2013 |

OTHER PUBLICATIONS

IP.com search (Year: 2020).*

* cited by examiner

*Primary Examiner* — Lisa Solomon
(74) *Attorney, Agent, or Firm* — Workman Nydegger

(57) ABSTRACT

The medium discharging apparatus includes a medium receiving portion that includes a first portion and a second portion that is provided on the first portion and that is configured to be displaced between a retracted position and an advanced position, a moving member configured to move between a first position and a second position, in which the moving member pushes and moves the second portion towards the advanced position as the moving member moves from the first position towards the second position and in which the moving member is moved to the first position as the second portion is displaced to the retracted position, a pushing member that pushes the moving member towards the second position, and a restricting member configured to switch between a restricting state that restricts a movement of the moving member towards the second position, and a non-restricting state that releases the restricting state.

13 Claims, 28 Drawing Sheets

MEDIUM DISCHARGING APPARATUS AND MEDIUM PROCESSING APPARATUS

The present application is based on, and claims priority from JP Application Serial Number 2018-208291, filed Nov. 5, 2018 and JP Application Serial Number 2019-010028, filed Jan. 24, 2019, the disclosures of which are hereby incorporated by reference herein in their entirety.

BACKGROUND

1. Technical Field

The present disclosure relates to a medium discharging apparatus that discharges a medium, and a medium processing apparatus including the same.

2. Related Art

In medium processing apparatuses that perform processing on a medium, there is one that includes a medium discharging apparatus that discharges a medium on a medium receiving tray and that is configured to stack the medium, on which the processing has been performed, on the medium receiving tray. Note that the medium receiving tray is called, in some cases, a discharge tray, a sheet discharge tray, a discharge stacker, or a sheet discharge stacker. The medium processing apparatus includes a recording apparatus, a representative example of which is the printer, or an image reading apparatus, a representative example of which is a scanner, for example.

For example, when the printer, which is an example of the medium processing apparatus, is configured to perform recording on a plurality of sizes of mediums, the medium receiving tray needs to have a length corresponding to the largest size recordable with the printer. If the size of the medium receiving tray is a fixed size corresponding to the largest size of the medium recordable with the printer, the apparatus becomes large in size; accordingly, there are cases in which the length of the medium receiving tray is configured to automatically change according to the size of the discharged medium.

For example, FIG. 1 in JP-A-2003-095515 discloses a configuration in which a medium receiving tray is stretched and shortened by a tray length controlling apparatus, which is a drive system driven by a motor and the like. Furthermore, FIG. 2 in JP-A-2003-095515 discloses a configuration in which the medium receiving tray is pulled by a spring in a contracting direction of the spring. The medium receiving tray countering the spring force is stretched by being pushed by the discharged medium, and when the medium is removed from the medium receiving tray, the medium receiving tray is automatically shortened by the spring force.

However, there are users that, rather than having the medium receiving tray be automatically adjusted, desire to optionally adjust the length of the medium receiving tray. As in the medium receiving tray disclosed in FIG. 1 in JP-A-2003-095515, in a configuration that changes the length with a tray length controlling apparatus operating through a motor, while it is possible to manually operate the medium receiving tray without driving the motor, performing a moving operation of the medium receiving tray manually may feel heavy when the drive system is coupled to the medium receiving tray.

Furthermore, the configuration disclosed in FIG. 2 in JP-A-2003-095515 in which the medium receiving tray is shortened by the spring force does not take into consideration the user manually setting the length to an optional length.

SUMMARY

A medium discharging apparatus of the present disclosure overcoming the above issue includes a discharge portion that discharges a medium, a medium receiving portion that receives the medium discharged by the discharge portion, the medium receiving portion including a first receiving portion, and a second receiving portion that is provided on the first receiving portion and that is configured to be displaced between a retracted position and an advanced position positioned downstream of the retracted position in a medium discharge direction, a moving member configured to move between a first position and a second position positioned downstream of the first position in the medium discharge direction, in which the moving member pushes and moves the second receiving portion towards the advanced position as the moving member moves from the first position towards the second position and in which the moving member is moved in the first position as the second receiving portion is displaced to the retracted position, a pushing member that pushes the moving member towards the second position, and a restricting member configured to switch between a restricting state that restricts a movement of the moving member towards the second position while countering pushing force of the pushing member, and a non-restricting state that releases the restricting state.

DESCRIPTION OF EXEMPLARY EMBODIMENTS

Figure 1:
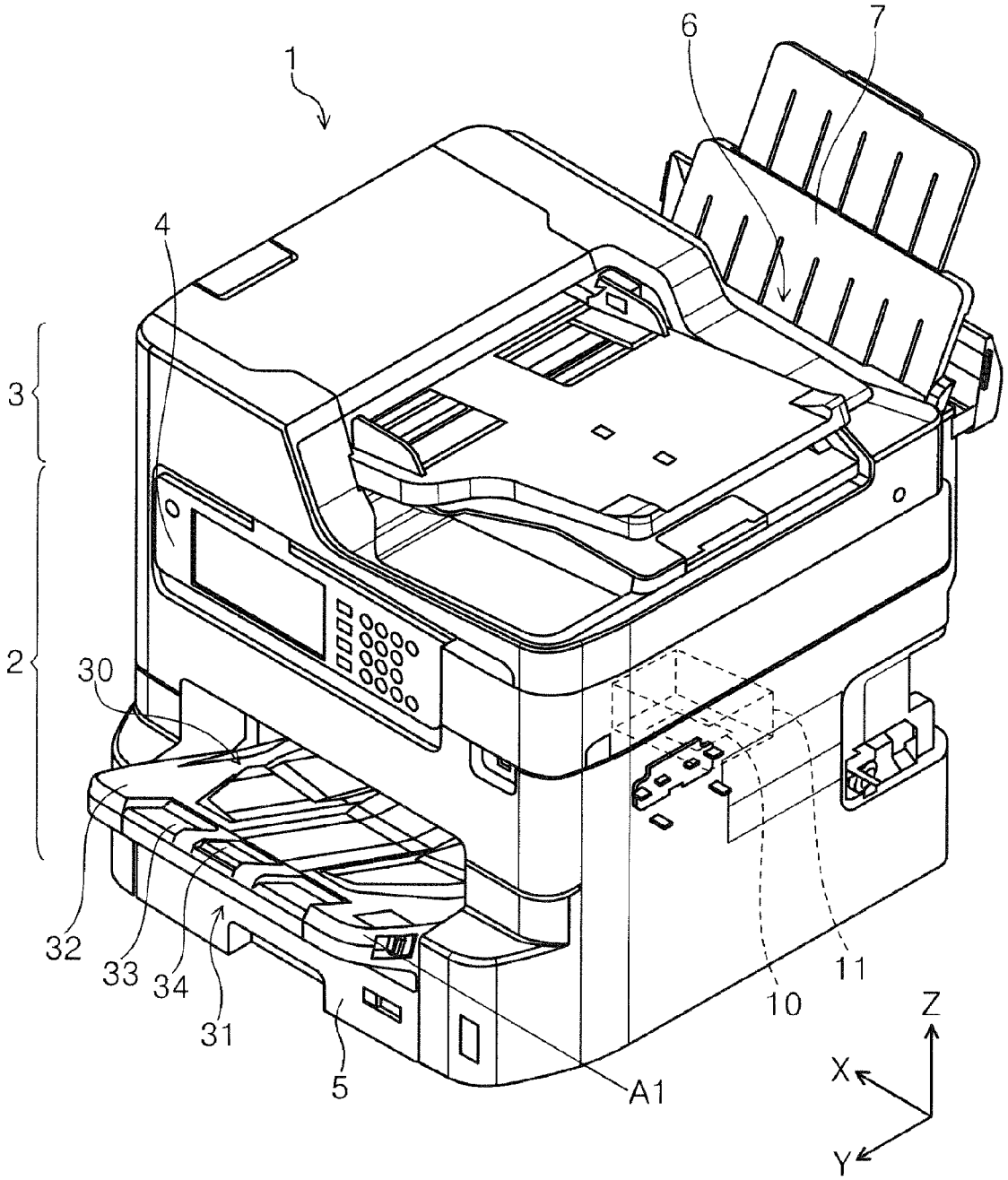
FIG. 1 is a perspective view of an external appearance of a printer including a medium discharging apparatus according to a first embodiment.

Hereinafter, the present disclosure will be described in a schematic manner.

A medium discharging apparatus according to a first aspect includes a discharge portion that discharges a medium, a medium receiving portion that receives the medium discharged by the discharge portion, the medium receiving portion including a first receiving portion, and a second receiving portion that is provided on the first receiving portion and that is configured to be displaced between a retracted position and an advanced position positioned downstream of the retracted position in a medium discharge direction, a moving member configured to move between a first position and a second position positioned downstream of the first position in the medium discharge direction, in which the moving member pushes and moves the second receiving portion towards the advanced position as the moving member moves from the first position towards the second position and in which the moving member is moved in the first position as the second receiving portion is displaced to the retracted position, a pushing member that pushes the moving member towards the second position, and a restricting member configured to switch between a restricting state that restricts a movement of the moving member towards the second position while countering pushing force of the pushing member, and a non-restricting state that releases the restricting state.

According to the present aspect, the second receiving portion is configured to be pushed towards the advanced position with the moving member, and the moving member can be in a state in which the movement thereof is restricted by the restricting member; accordingly, in a state in which the movement of the moving member is restricted, the second receiving portion can be moved towards the advanced position with the user operation and be stopped at a predetermined position without being affected by the push of the moving member. In other words, when the second receiving portion is displaced by the user operation, the second receiving portion does not receive any load from the drive mechanism coupled to a motor or the like and can be stopped at a predetermined position with the user operation.

With the above configuration, usability of the medium discharging apparatus for the user can be improved.

A second aspect according to the first aspect may further include a medium length acquiring member that acquires a length of the medium discharged by the discharge portion, and a restricting member control unit that switches the restricting member to the non-restricting state when the length of the medium is equivalent to or larger than a predetermined length.

According to the present aspect, the second receiving portion is displaced from the retracted position to the advanced position according to the length of the medium without the user operation; accordingly, a problem such as the discharge medium dropping off from the medium receiving portion due to the user forgetting to operate the second receiving portion can be prevented.

In a third aspect according to the first or second aspect, the moving member may include an abutting portion that abuts against an abutted portion provided in the second receiving portion when the moving member moves towards the second position.

According to the present aspect, since the moving member includes the abutting portion that abuts against the abutted portion provided in the second receiving portion when the moving member moves towards the second position, the second receiving portion can be reliably displaced in the advancing direction by pushing the second receiving portion with the moving member moving towards the second position.

In a fourth aspect according to any one of the first to third aspects, the second receiving portion may be configured to move downstream of the moving member in the medium discharge direction when the moving member is at the first position, and the moving member may include a contact portion that creates a frictional resistance with the second receiving portion.

According to the present aspect, when the moving member is at the first position and when the second receiving portion moves downstream of the moving member in the medium discharge direction, a frictional resistance is generated between the moving member and the second receiving portion to suppress the second receiving portion from sliding and moving relative to the moving member with momentum. Furthermore, it will be easier to stop the second receiving portion at an optional position with respect to the moving member in the medium discharge direction.

A fifth aspect according to any one of the first to fourth aspects may include an apparatus body unit that includes the discharge portion and the medium receiving portion, in which the medium receiving portion is configured to detach from the apparatus body unit.

According to the present aspect, since the medium receiving portion is configured to be detached from the apparatus body unit, for example, when the medium receiving portion is not used, the medium receiving portion can be detached and the medium discharging apparatus can be installed while saving space.

A sixth aspect according to the first to fifth aspects may include a buffer mechanism that reduces a moving speed of the second receiving portion moving from the retracted position to the advanced position by being pushed by the moving member.

When the second receiving portion receiving the pushing force of the pushing member through the moving member is displaced in the advancing direction, the second receiving portion may advance in the advancing direction with momentum.

Since the present aspect includes the buffer mechanism that reduces the moving speed of the second receiving portion moving from the retracted position to the advanced position by being pushed by the moving member, the second receiving portion can be slowly displaced to the advanced position during the automatically advancing operation.

In a seventh aspect according to the sixth aspect, a plurality of the buffer mechanisms arranged in a moving direction of the second receiving portion may be provided, and a number of buffer mechanisms that acts on the second receiving portion may change as the second receiving portion moves from the retracted position towards the advanced position.

According to the present aspect, since the number of buffer mechanisms that acts on the second receiving portion changes as the second receiving portion moves from the retracted position towards the advanced position, the degree of buffer action can be changed while the second receiving portion moves from the retracted position towards the advanced position. Accordingly, the speed at which the second receiving portion advances can be adjusted.

In an eighth aspect according to the seventh aspect, the number of buffer mechanisms that acts on the second receiving portion may decrease as the second receiving portion moves from the retracted position towards the advanced position.

When the buffer action of the buffer mechanisms is small, the action of reducing the displacement speed of the second receiving portion becomes insufficient and the second receiving portion may pop out with momentum immediately after the start of the advancement. On the other hand, when the buffer action of the buffer mechanisms is large, while the jumping out of the second receiving portion at the start of the advancement can be suppressed, the buffer action against the pushing force of the pushing member may be excessive and may lead to a state in which the advancement of the second receiving portion is not completed before the discharge of the medium.

According to the present aspect, since the number of buffer mechanisms that acts on the second receiving portion decreases as the second receiving portion moves from the retracted position towards the advanced position, the buffer action can be reduced while the second receiving portion moves from the retracted position towards the advanced position.

Accordingly, suppression of the second receiving portion jumping out immediately after the start of the advancement, and avoidance of a state in which the advancement of the second receiving portion is not completed due to an excessively large buffer action can both be achieved.

In a ninth aspect according to the seventh aspect, the number of buffer mechanisms that acts on the second receiving portion may increase after being decreased, as the second receiving portion moves from the retracted position towards the advanced position.

According to the present aspect, as the second receiving portion moves from the retracted position towards the advanced position, since the number of buffer mechanisms that acts on the second receiving portion increases after being decreased, the buffer action can be, after temporarily being decreased, increased once more while the second receiving portion moves from the retracted position towards the advanced position.

By temporarily reducing the buffer action with the buffer mechanisms as the second receiving portion advances, suppression of the second receiving portion jumping out immediately after the start of the advancement, and avoidance of a state in which the advancement of the second receiving portion is not completed due to an excessively large buffer action can both be achieved.

Furthermore, since the buffer action with the buffer mechanisms that had been temporarily reduced is increased once again, the hitting sound and the vibration generated by the second receiving portion reaching the advanced position with momentum can be suppressed.

In a tenth aspect according to the seventh aspect, the number of buffer mechanisms that acts on the second receiving portion may increase as the second receiving portion moves from the retracted position towards the advanced position.

According to the present aspect, since the number of buffer mechanisms that acts on the second receiving portion increases as the second receiving portion moves from the retracted position towards the advanced position, the buffer action can be increased while the second receiving portion moves from the retracted position towards the advanced position.

Accordingly, for some time after the advancement of the second receiving portion has been started, the second receiving portion is moved at a high speed by reducing the action of the buffer mechanisms, and when the second receiving portion becomes close to the advanced position, the action of the buffer mechanisms is increased to suppress the hitting sound and the vibration generated by the second receiving portion reaching the advanced position with momentum.

In an eleventh aspect according to any one of the first to tenth aspects, the restricting member may be configured to switch between a first restricting state that restricts the moving member at the first position, and a second restricting state that restricts the moving member at a downstream position that is closer to the second position than the first position.

According to the present aspect, since the restricting member is configured to switch between the first restricting state that restricts the moving member at the first position, and the second restricting state that restricts the moving member at the downstream position that is closer to the second position than the first position, in the automatically advancing operation, the advanced position of the second receiving portion can be selected between two positions that are different in the amount of advancement.

A medium processing apparatus according to a twelfth aspect may include a processing portion that performs processing on a medium, and the medium discharging apparatus according to any one of the first to eleventh aspects that discharges the medium on which processing has been performed in the processing portion.

According to the present aspect, an effect similar to those of the first to eleventh aspects can be obtained with the medium processing apparatus that includes the processing portion that performs processing on the medium, and the medium discharging apparatus that discharges the medium on which processing has been performed in the processing portion.

In a thirteenth aspect according to the twelfth aspect, the medium processing apparatus may be a recording apparatus that includes a recording unit serving as the processing portion, in which the recording unit performs a recording process on the medium.

According to the present aspect, an effect similar to that of the twelfth aspect can be obtained in the recording apparatus including the recording unit serving as the processing portion that performs recording on the medium.

First Embodiment

A description of a recording apparatus that is an example of a medium processing apparatus according to an embodiment of the present disclosure will be described with reference to the drawings. An ink jet printer 1 will be described as an example of the recording apparatus. Hereinafter, the ink jet printer 1 will be merely referred to as a printer 1.

Note that in the X-Y-Z coordinate system illustrated in each drawing, the X direction is the width direction of the apparatus, the Y direction is the depth direction of the apparatus, and the Z direction is the height direction of the apparatus. Furthermore, the +Y direction side is the front side of the apparatus, and the −Y direction side is the rear side of the apparatus. Furthermore, when viewed from the front side of the apparatus, the left side is the +X direction and the right side is the −X direction. Furthermore, the +Z direction side is referred to as the upper side, and the −Z direction side is referred to as the lower side. Furthermore, a transport direction in which the medium is transported in the printer 1 is referred to as "downstream", and a direction opposite to the transport direction is referred to as "upstream".

Outline of Printer

Referring hereinafter to FIG. 1, an outline of the printer 1 will be described.

The printer 1 illustrated in FIG. 1 includes an apparatus body unit 2 including therein a recording head 10 serving as a "recording unit" that performs a recording process on a medium, and a scanner unit 3 provided above the apparatus body unit 2. The recording head 10 is also an example of a "processing portion" that performs a process on the medium.

The printer 1 includes the recording head 10, and a medium discharging apparatus 30 that discharges the medium on which the recording process has been performed with the recording head 10.

The recording head 10 is mounted on a carriage 11 configured to move in an X-axis direction that is a width direction of the apparatus, and is configured as an ink jet recording head that performs recording by ejecting ink, which is a liquid, on a medium while moving in the X-axis direction.

The medium on which recording is performed in the printer 1 includes recording sheets such as plain paper, thin paper, thick paper, and coated paper such as photographic paper.

The scanner unit 3 described above is provided above the apparatus body unit 2 of the present embodiment, and the printer 1 is configured as a multifunction machine provided with not only a recording function but also with a scanning function that reads a document. An operation unit 4 that operates the printer 1 including the scanner unit 3 is provided on a front surface of the printer 1. The operation unit 4 is configured to command the start and the stoppage of a recording operation or a reading operation and is configured so that setting information such as the size of the medium or the document, the type of paper, and the like is input thereto. The input information input to the operation unit 4 is transmitted to a control unit 21 illustrated in FIG. 2 so that various operations in the printer 1 are controlled.

A medium accommodation portion 5 is provided in the printer 1. The medium accommodation portion 5 is provided in a portion of the apparatus body unit 2 and is configured to accommodate the medium on which recording is to be performed. The medium can be accommodated in the medium accommodation portion 5 by drawing out the medium accommodation portion 5 in the +Y direction, or towards a frontal side of the apparatus. Furthermore, a medium setting portion 6 configured so that the medium, to which recording is to be performed, is set thereon is provided in a rear upper portion of the printer 1. Reference numeral 7 is a paper support that supports the medium set on the medium setting portion 6.

In the printer 1, the medium supplied towards the recording head 10 can be sent from either the medium accommodation portion 5 or from the medium setting portion 6.

The medium on which the recording process has been performed with the recording head 10 provided inside the apparatus body unit 2 is discharged external to the apparatus body unit 2 with the medium discharging apparatus 30. A medium receiving portion 31 that receives the medium discharged from the apparatus body unit 2 is provided on the front side of the apparatus body unit 2.

Hereinafter, after describing transport paths of the medium in the printer 1 in detail, a configuration of the medium receiving portion 31 provided in the medium discharging apparatus 30 will be described in detail.

Medium Transport Paths in Printer

Figure 2:
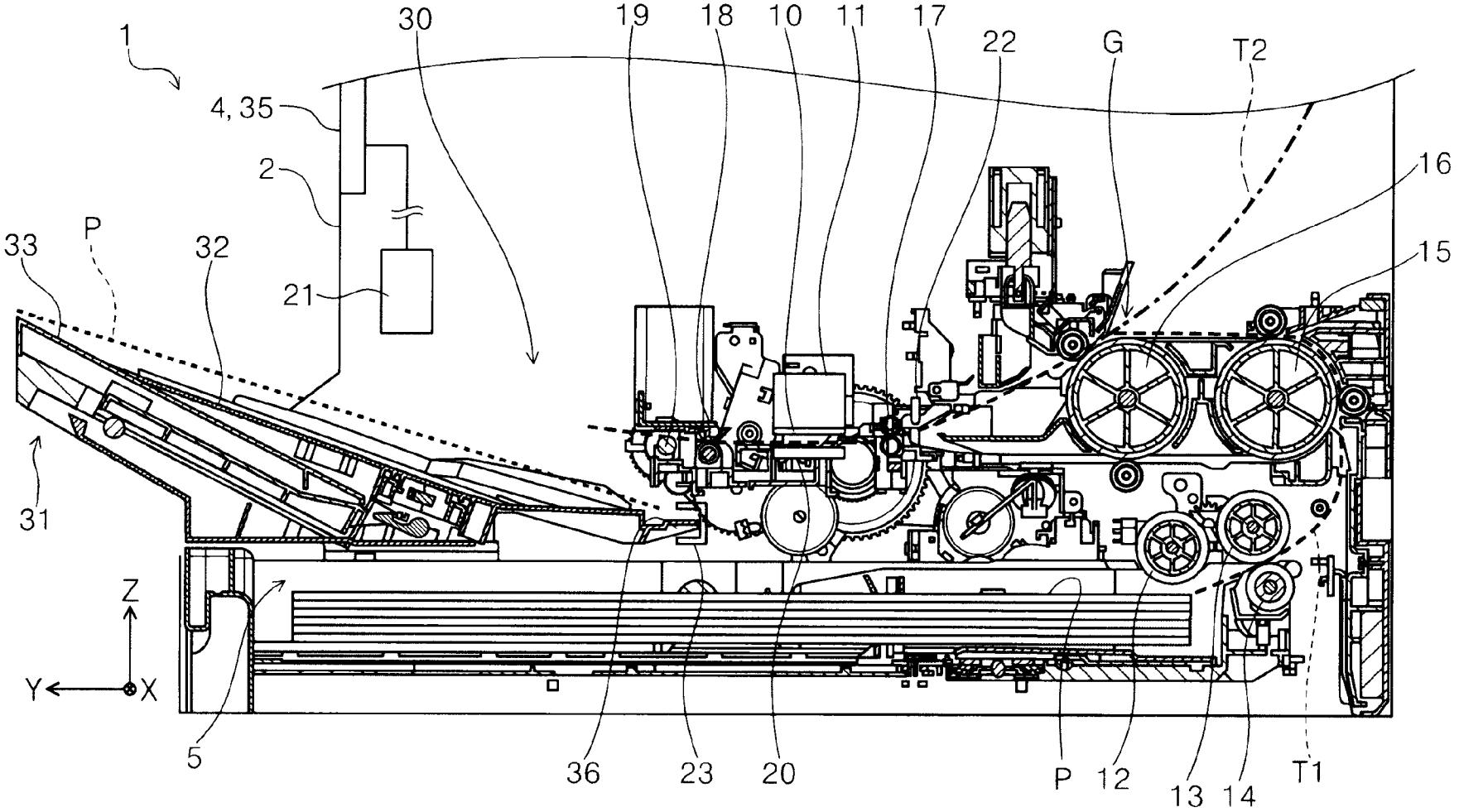
FIG. 2 is a sectional side view of the printer according to the first embodiment.

Referring to FIG. 2, medium transport paths in the printer 1 will be described.

A broken line indicated by sign T1 in FIG. 2 illustrates a medium transport path from the medium accommodation portion 5. Hereinafter, the above path will be referred to as a medium transport path T1. Furthermore, a dot and dash line indicated by sign T2 illustrates a medium transport path from the medium setting portion 6. The above path will be referred to as a medium transport path T2.

The medium transport path T1 will be described first.

Sign P in FIG. 2 indicates a stack of mediums P set in the medium accommodation portion 5 provided in the lower portion of the apparatus body unit 2. A pickup roller 12, a feed roller 13, and a separating roller 14 are provided in an upper portion of the medium accommodation portion 5 in the −Y direction.

In the mediums P accommodated in the medium accommodation portion 5, the uppermost medium is picked up by the pickup roller 12 and is sent out towards an inverting roller 15. When the pickup roller 12 picks up a plurality of mediums, each of the mediums are separated into a single sheet with the feed roller 13 and the separating roller 14.

The inverting roller 15 is a roller that transports the medium P while inverting the medium P with the outer peripheral surface thereof. By being inverted with the inverting roller 15, the medium P having the surface that had been facing upwards in the medium accommodation portion 5 face downwards is sent towards a transport roller 16 located downstream, and is sent to a pair of transport rollers 17 located further downstream.

The pair of transport rollers 17 are provided upstream of the recording head 10 in the medium transport direction. The medium P is sent to a region opposing the recording head 10 with the pair of transport rollers 17. A medium support member 20 that supports the medium P is provided below the recording head 10, in other words, the medium support member 20 is provided in a region opposing the recording head 10. The recording process is performed by ejecting ink from the recording head 10 onto the medium P passing below the recording head 10 while the medium P is supported by the medium support member 20.

Note that a liquid containing body (not shown) containing ink supplied to the recording head 10 is provided in the printer 1. The ink is supplied to the recording head 10 from the liquid containing body through a tube (not shown). Furthermore, a suction mechanism that suctions the medium P against a support surface of the medium support member 20 can be provided in the medium support member 20. For example, absorption through suction or electrostatic adsorption may be used in the suction mechanism.

The printer 1 includes the medium discharging apparatus 30 that discharges the medium P on which the recording process has been performed with the recording head 10. The medium discharging apparatus 30 includes a first pair of discharge rollers 18 and a second pair of discharge rollers 19 that are provided downstream of the recording head 10 in the medium transport direction and that serve as "discharge portions" that discharge the medium P, and the medium receiving portion 31 that receives the medium P discharged by the second pair of discharge rollers 19.

The medium P after the recording process is sent downstream by the first pair of discharge rollers 18 and the second pair of discharge rollers 19 and is stacked on the medium receiving portion 31. Note that the second pair of discharge rollers 19 directly upstream the medium receiving portion 31 alone can be deemed as the "discharge portion".

The medium transport path T2 through which the medium set in the medium setting portion 6 is transported merges with the medium transport path T1 at a merge portion G. From here and after, the medium P is transported through the medium transport path T1 and is discharged by the first pair of discharge rollers 18 and the second pair of discharge rollers 19 to the medium receiving portion 31 after the recording process has been performed thereon with the recording head 10.

Note that the printer 1 is configured to perform a so-called double-sided recording in which the medium is inverted after the recording process is performed on a first surface of the medium P to perform the recording process also on the second surface, which is a surface opposite the first surface. In the present embodiment, a description of an inversion path, in which the medium to which the recording process has been performed on the first surface of the medium P is inverted, is omitted.

Note that the printer 1 is configured to perform recording on a variety of sizes of mediums P, and the medium discharging apparatus 30 is configured so that the length of the medium receiving portion 31 in the medium transport direction (a Y-axis direction) can be changed. A further detailed description of the medium discharging apparatus 30 will be given below.

Regarding Medium Discharging Apparatus

As illustrated in FIG. 2, the medium discharging apparatus 30 includes the first pair of discharge rollers 18 and the second pair of discharge rollers 19 described above, the medium receiving portion 31, and a medium length acquiring member 35 that acquires the length of the medium p discharged by the first pair of discharge rollers 18 and the second pair of discharge rollers 19. As an example of the medium length acquiring member 35, the operation unit 4 configured to have information on the size settings of the medium P input thereto can be used.

The first pair of discharge rollers 18, the second pair of discharge rollers 19, and the medium receiving portion 31 are provided in the apparatus body unit 2.

Figure 3:
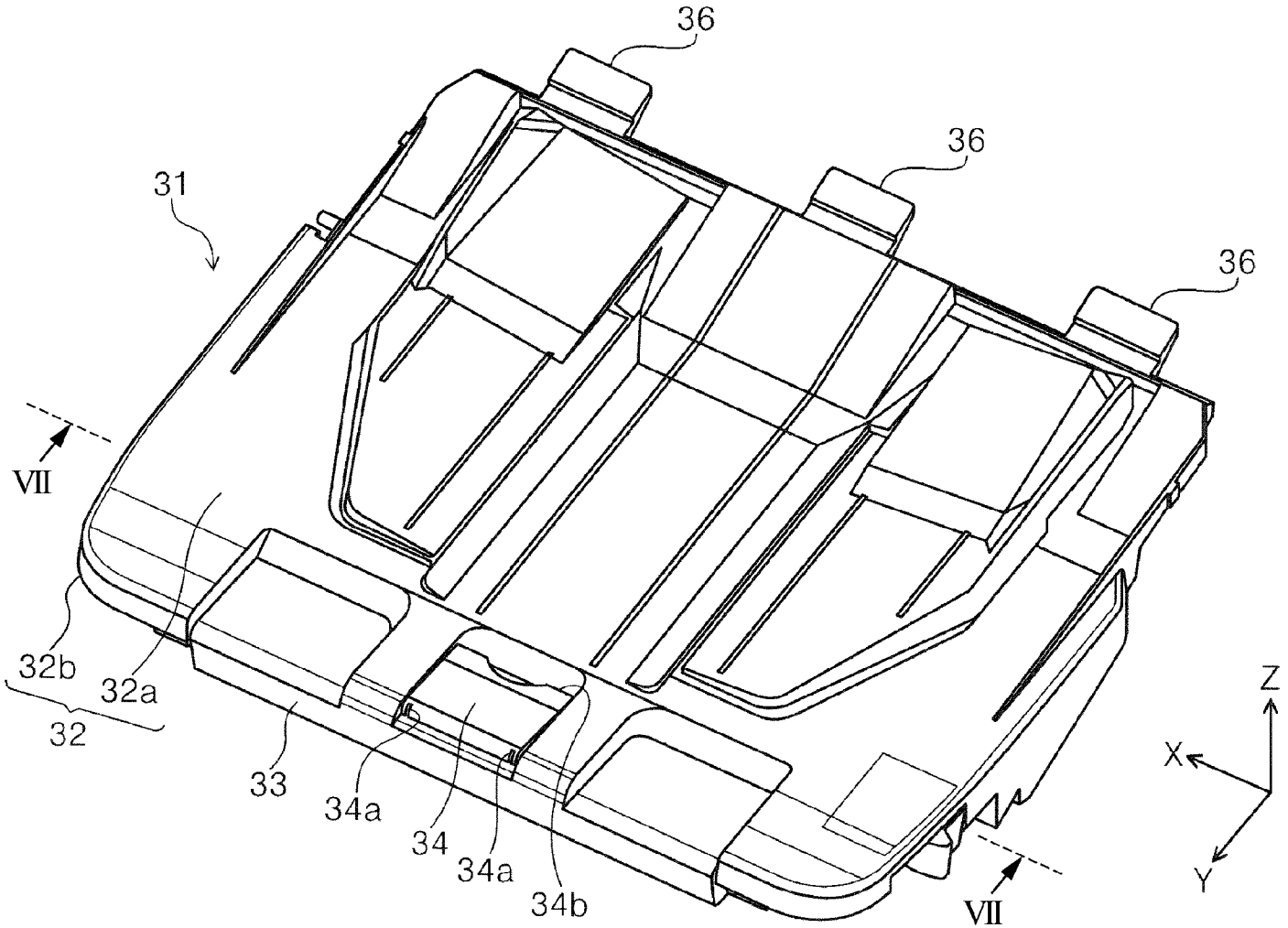
FIG. 3 is a perspective view of a medium receiving portion that has been detached from an apparatus body unit.
Figure 4:
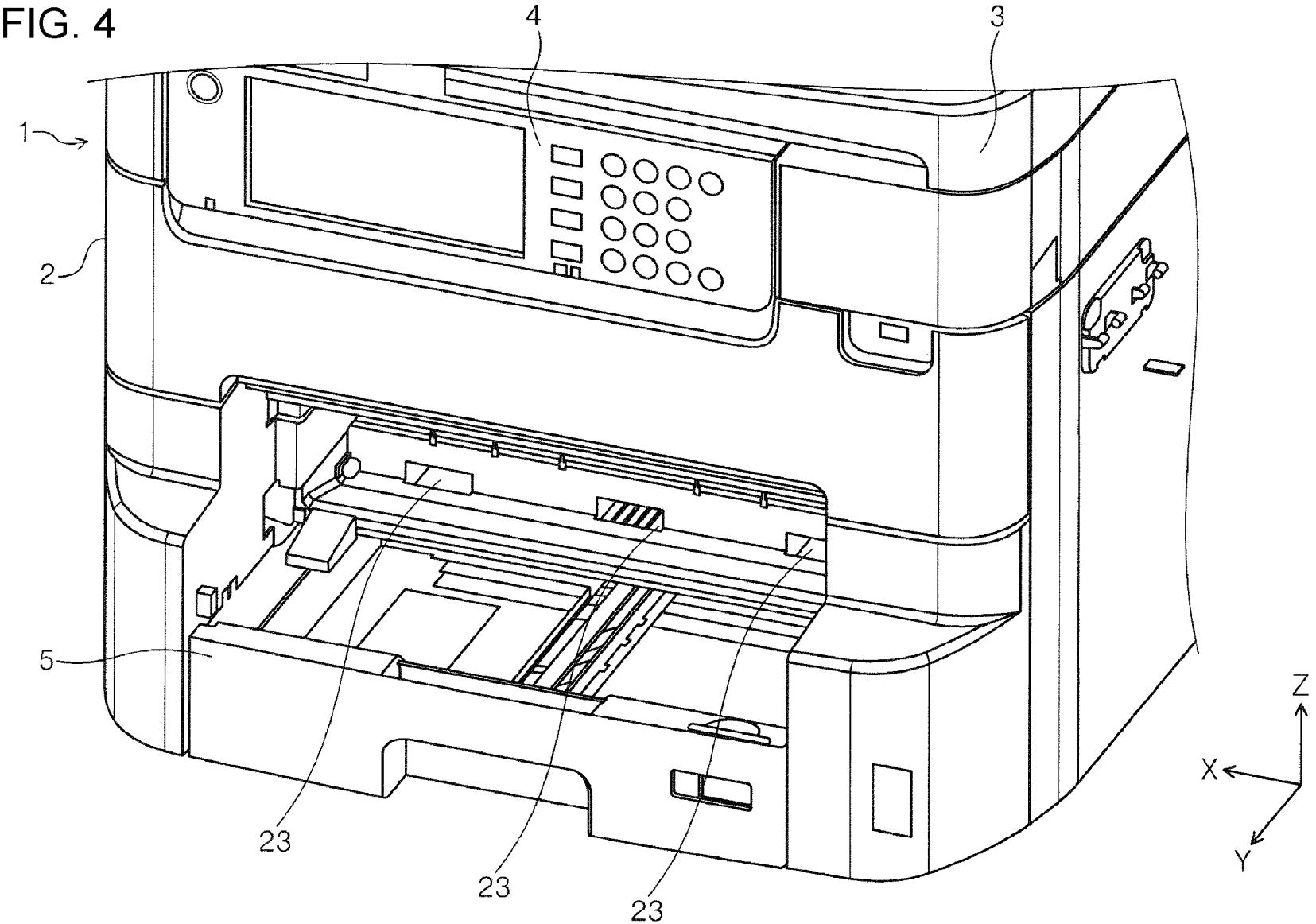
FIG. 4 is a perspective view of the apparatus body unit from which the medium receiving portion has been detached.

Regarding Attachment and Detachment of Medium Receiving Portion to Apparatus Body Unit As illustrated in FIGS. 3 and 4, the medium receiving portion 31 is configured to be detached from the apparatus body unit 2. FIG. 3 illustrates the medium receiving portion 31 detached from the apparatus body unit 2, and FIG. 4 illustrates the apparatus body unit 2 from which the medium receiving portion 31 has been detached.

In the apparatus body unit 2 illustrated in FIG. 4, a plurality of attaching portions 23 are provided at intervals in the X-axis direction, which is the width direction of the apparatus. Attached portions 36, which is attached to the attaching portions 23 (FIG. 4), are provided at an end portion of the medium receiving portion 31 in the −Y direction illustrated in FIG. 3. A plurality of attached portions 36 are provided at intervals in the X-axis direction, which is the width direction of the apparatus, so as to correspond to the attaching portions 23.

As illustrated in FIG. 1, the medium receiving portion 31 is attached to the apparatus body unit 2 by having the attached portions 36 (FIG. 3) of the medium receiving portion 31 be fitted into the attaching portions 23 (FIG. 4) of the apparatus body unit 2. With the above, the medium receiving portion 31 is configured to receive the medium P discharged from the printer 1.

By configuring the medium receiving portion 31 to be detached from the apparatus body unit 2, when the medium receiving portion 31 is not used, for example, the medium receiving portion 31 can be detached and the installation space of the printer 1 can be reduced. Furthermore, as illustrated in FIG. 4, when the medium receiving portion 31 is detached, a medium accommodation space of the medium accommodation portion 5 becomes exposed; accordingly, by slightly drawing out the medium accommodation portion 5, the mediums can be filled in the medium accommodation portion 5.

Regarding Configuration of Medium Receiving Portion

The medium receiving portion 31 illustrated in FIG. 3 includes a first receiving portion 32 and a second receiving portion 33. The attached portions 36 are provided at an end portion of the first receiving portion 32 in the −Y direction. When the printer 1 is in a state illustrated in FIG. 1 in which the medium receiving portion 31 is attached to the apparatus body unit 2, the relative position of the first receiving portion 32 with respect to the apparatus body unit 2 is fixed.

Figure 5:
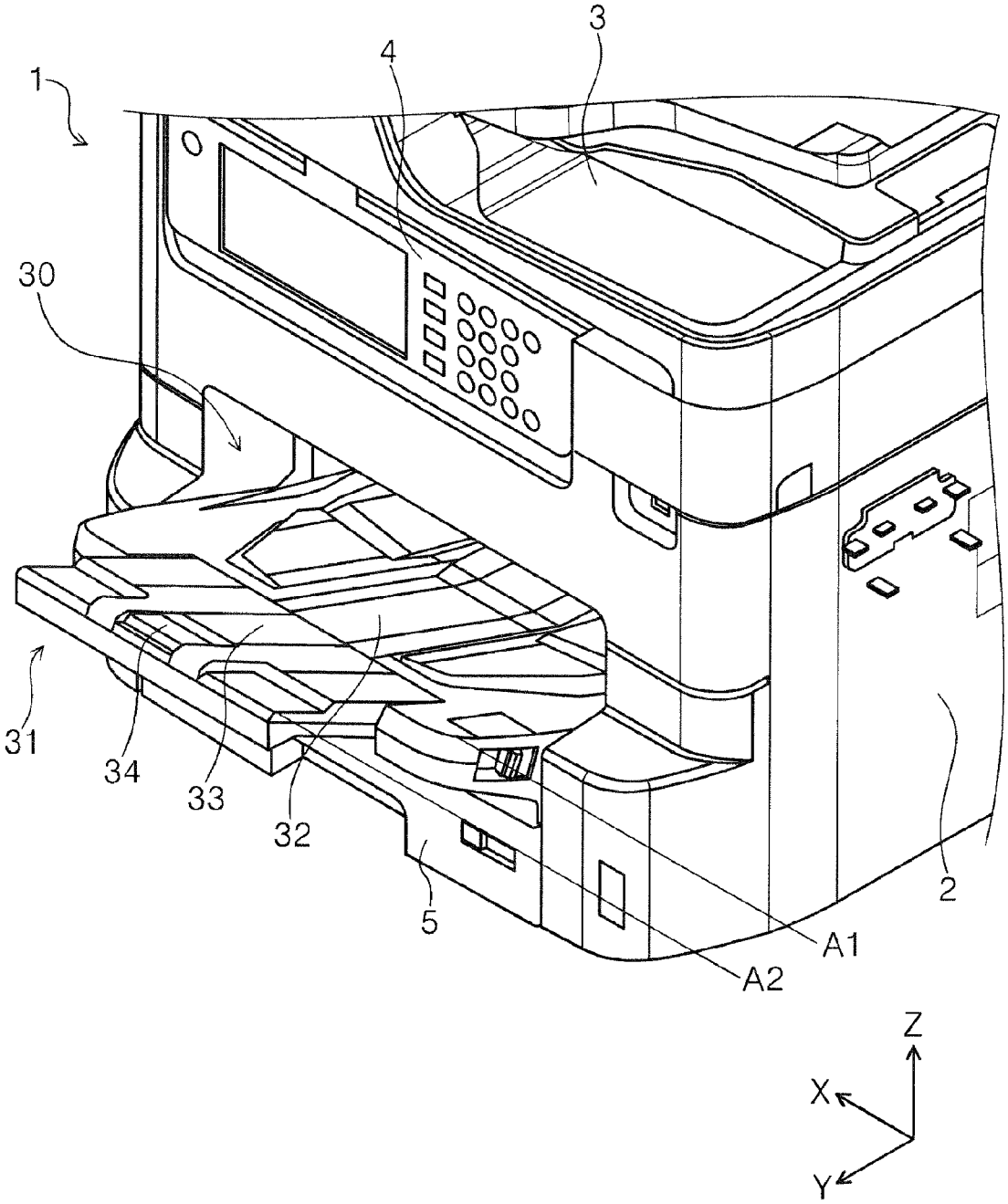
FIG. 5 is a perspective view illustrating a state in which a second receiving portion of the medium receiving portion is at an advanced position.
Figure 7:
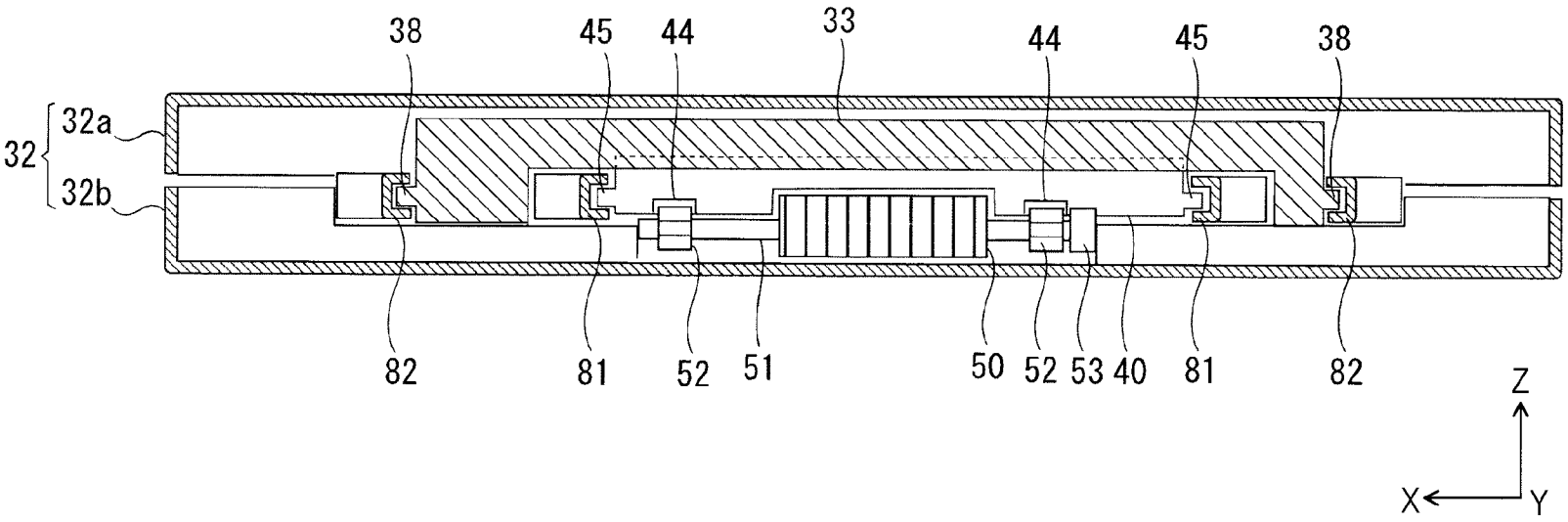
FIG. 7 is a schematic diagram of a cross-section taken along line VII-VII in FIG. 3.

The second receiving portion 33 is, relative to the first receiving portion 32, configured to advance and retract in the Y-axis direction. More specifically, the second receiving portion 33 is configured to be displaced between a retracted position A1 illustrated in FIG. 1 in which a leading end of the second receiving portion 33 in the +Y direction, which is a discharge direction of the medium with the first pair of discharge rollers 18 and the second pair of discharge rollers 19, is disposed at a position near the first receiving portion 32, and an advanced position A2 illustrated in FIG. 5 in which the leading end of the second receiving portion 33 is disposed at a position farther away from the first receiving portion 32 than the retracted position A1. As illustrated in FIG. 7, the second receiving portion 33 includes second-receiving-portion guide portions 38 and 38 on both sides in the width direction (the X-axis direction), and the second-receiving-portion guide portions 38 and 38 guided by second-receiving-portion guide rails 82 and 82 fixed to the first receiving portion 32 are advanced and retracted in the Y-axis direction.

Note that in each of the drawings, the retracted position A1 and the advanced position A2 of the second receiving portion 33 are based on the position of the leading end of the second receiving portion 33 in the +Y direction.

In the present embodiment, the retracted position A1 (FIG. 1) of the second receiving portion 33 is a position in which the position of the leading end of the first receiving portion 32 and the position of the leading end of the second receiving portion 33 are the same. The advanced position A2 (FIG. 5) of the second receiving portion 33 is a position in which the leading end of the second receiving portion 33 is advanced in the +Y direction with respect to the leading end of the first receiving portion 32.

Furthermore, an auxiliary receiving portion 34 is provided in the leading end of the second receiving portion 33 illustrated in FIG. 3. The auxiliary receiving portion 34 includes pivot shafts 34*a* in the +Y direction and is configured to pivot while having an end portion 34*b* as a free end. The auxiliary receiving portion 34 is configured to switch between a state illustrated in FIG. 3 or 5 in which the auxiliary receiving portion 34 forms a flat surface that is substantially the same as the mount surface of the second receiving portion 33, and a state illustrated in FIG. 6 in which the end portion 34*b* is pivoted as a free end about the pivot shafts 34*a* and in which the auxiliary receiving portion 34 is erect in a direction intersecting the mount surface of the second receiving portion 33.

Figure 6:
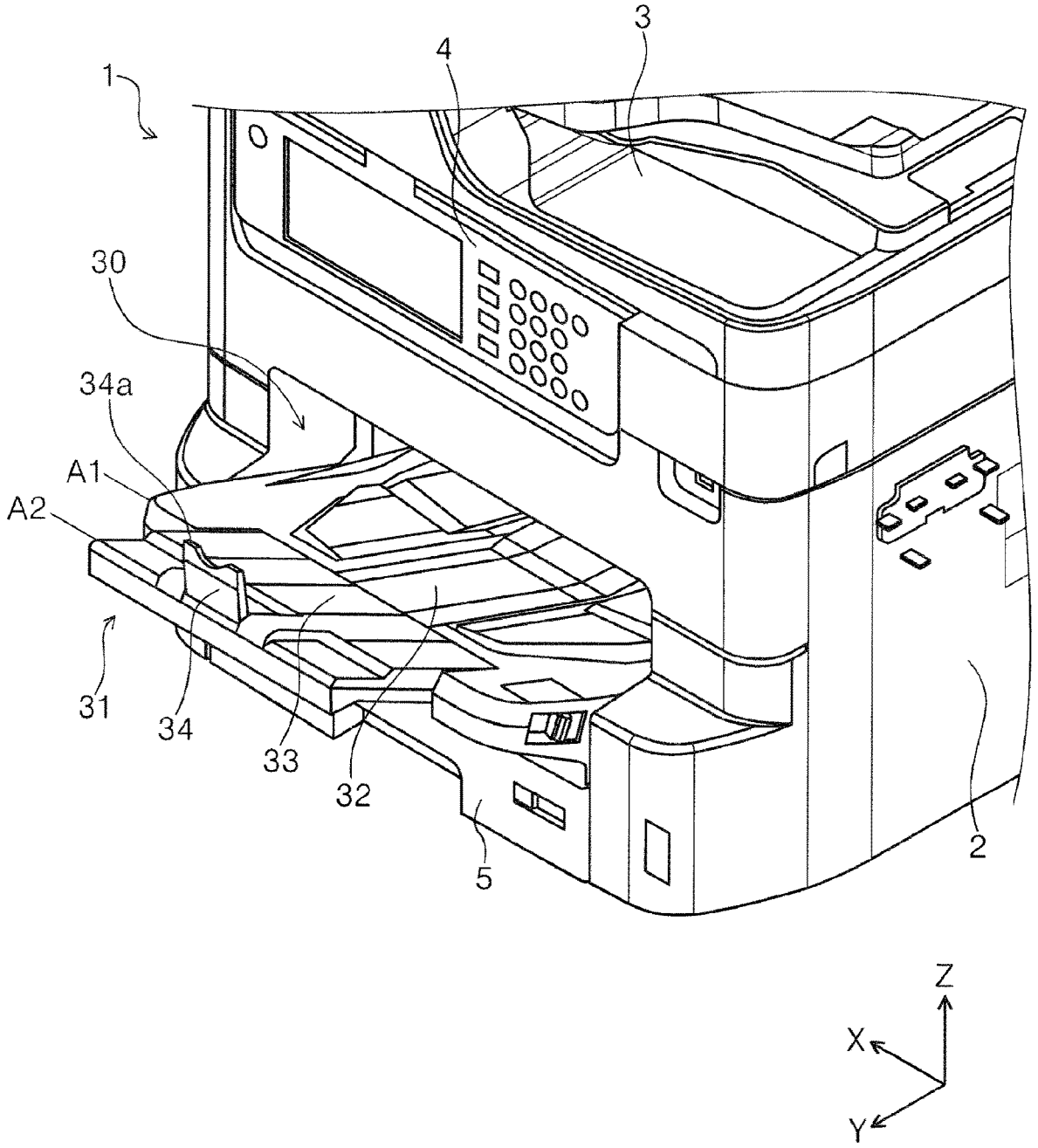
FIG. 6 is a perspective view illustrating a state in which the second receiving portion of the medium receiving portion is at the advanced position and in which an auxiliary receiving portion is erected.

By having the auxiliary receiving portion 34 be in an erect state illustrated in FIG. 6, for example, the medium P discharged to the medium receiving portion 31 can be prevented from sticking out in the +Y direction when mounted. Furthermore, when the plurality of mediums P are mounted on the medium receiving portion 31, the positions of the leading ends of the mediums P can be arranged.

The auxiliary receiving portion 34 can be in the erect state even when the second receiving portion 33 is positioned at the retracted position A1 illustrated in FIG. 1.

As described above, by having the medium receiving portion 31 include the first receiving portion 32 fixed to the apparatus body unit 2, and the second receiving portion 33 configured to advance and retract with respect to the first receiving portion 32, the length of the medium receiving portion 31 in the discharge direction can be changed.

Note that the medium discharging apparatus 30 is configured to perform an automatically advancing operation in which the displacement of the second receiving portion 33 from the retracted position A1 to the advanced position A2 is performed automatically according to the size of the medium P, and a passively advanced operation in which the displacement is performed manually by the user. A displacement mechanism in which the second receiving portion 33 is displaced from the retracted position A1 to the advanced position A2 will be described below.

Regarding Displacement Mechanism of Second Receiving Portion

Figure 9:
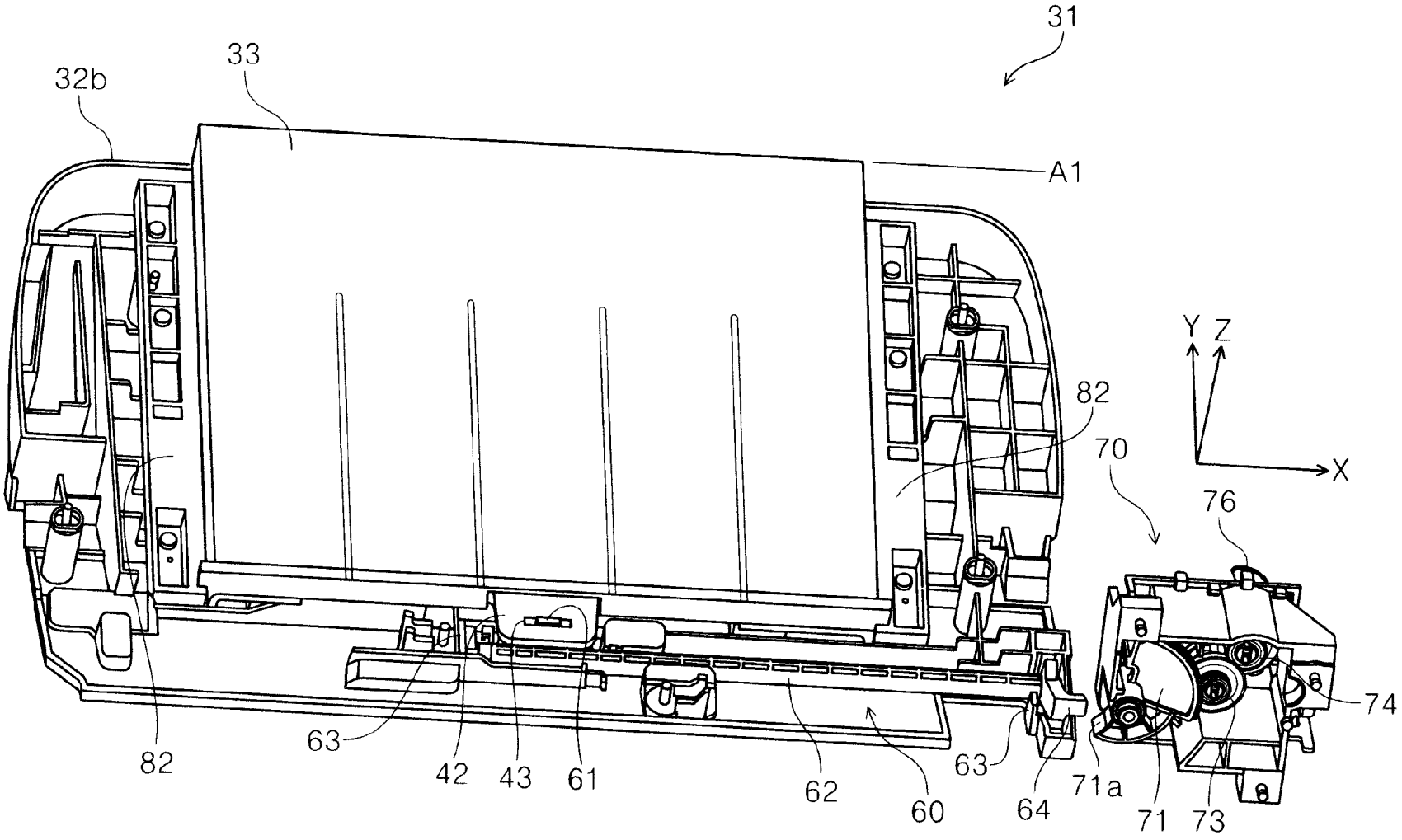
FIG. 9 is a perspective view illustrating the medium receiving portion from which an upper unit has been detached, and illustrates a state in which the second receiving portion is positioned at a retracted position.
Figure 10:
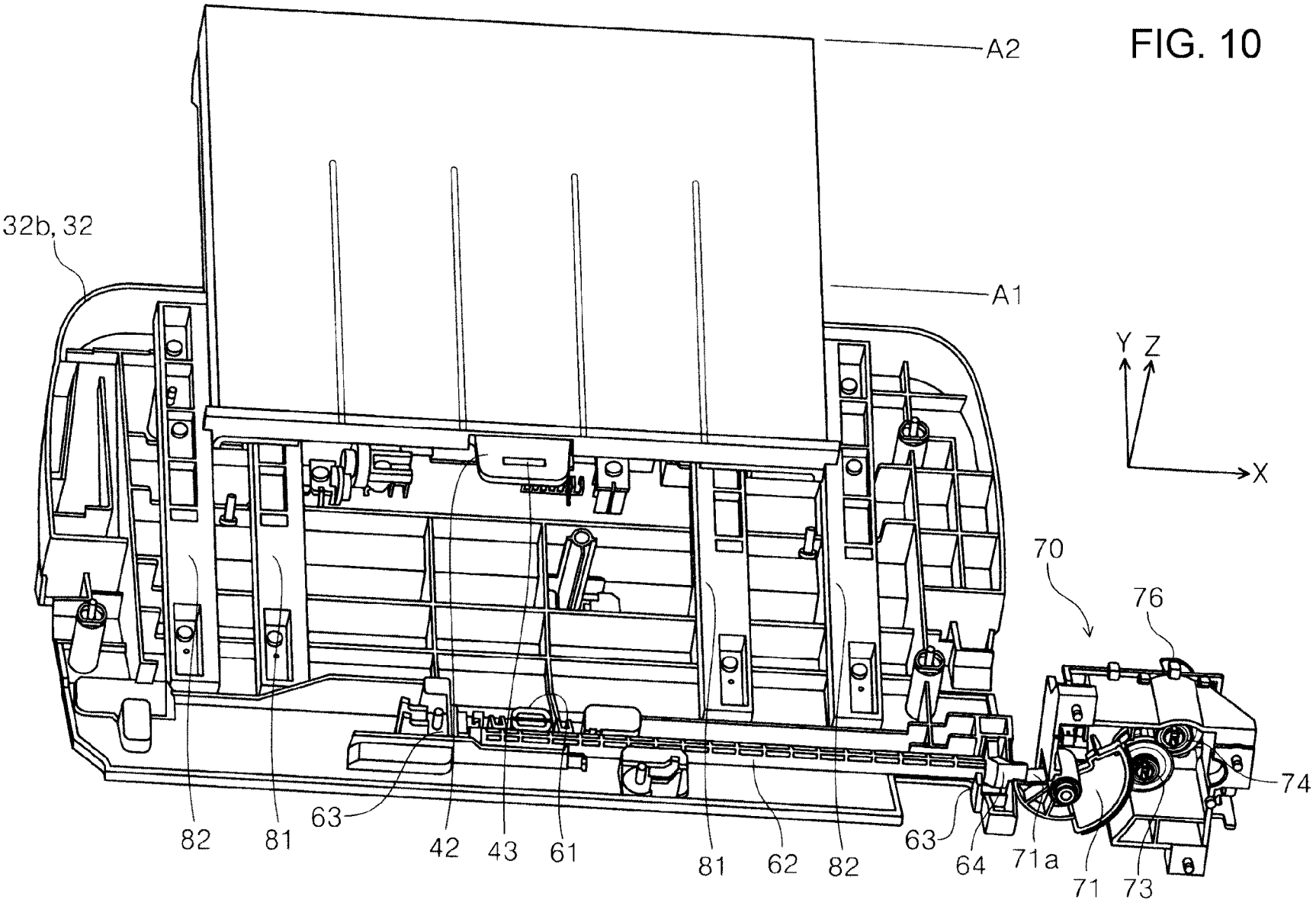
FIG. 10 is a perspective view illustrating the medium receiving portion from which the upper unit has been detached, and illustrates a state in which the second receiving portion pushed by the moving member has been displaced to the advanced position.
Figure 11:
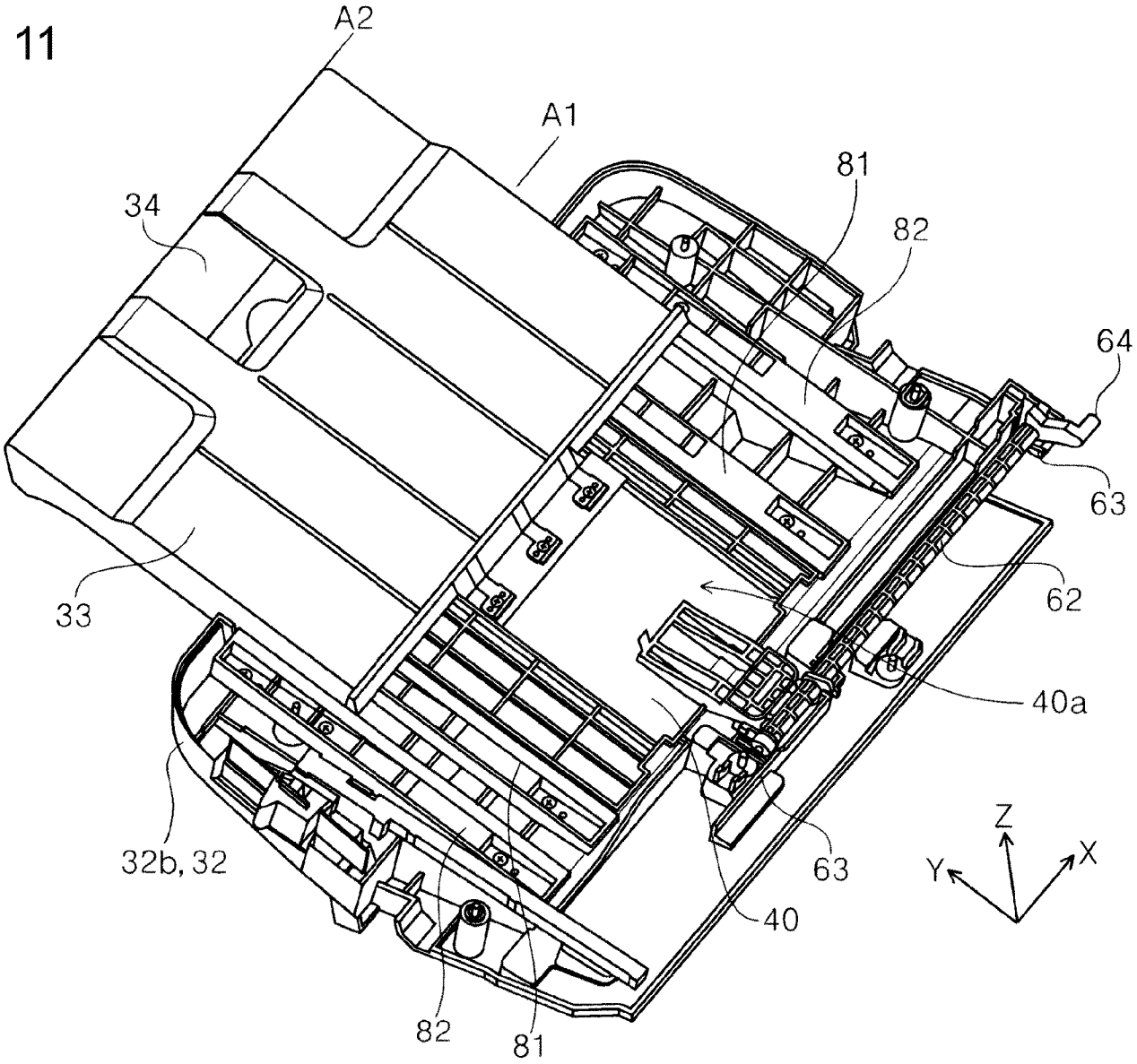
FIG. 11 is a perspective view illustrating the medium receiving portion from which the upper unit has been detached, and illustrates a state in which the second receiving portion pushed by external force other than from the moving member is displaced to the advanced position.

Referring to the medium receiving portion 31 illustrated in FIG. 3, the first receiving portion 32 is formed by combining an upper unit 32*a* that forms the mount surface of the medium P, and a lower unit 32*b* provided on the upper unit 32*a*. As illustrated in FIG. 7, the second receiving portion 33 is accommodated in a space between the upper unit 32*a* and the lower unit 32*b*. FIG. 9 illustrates a state in which the upper unit 32*a* of the first receiving portion 32 has been removed from the medium receiving portion 31 in which the second receiving portion 33 is positioned at the retracted position A1. Note that the medium receiving portion 31 illustrated in FIGS. 9 to 11 depicts a state in which the upper unit 32*a* of the first receiving portion 32 has been removed from the medium receiving portion 31.

Figure 12:
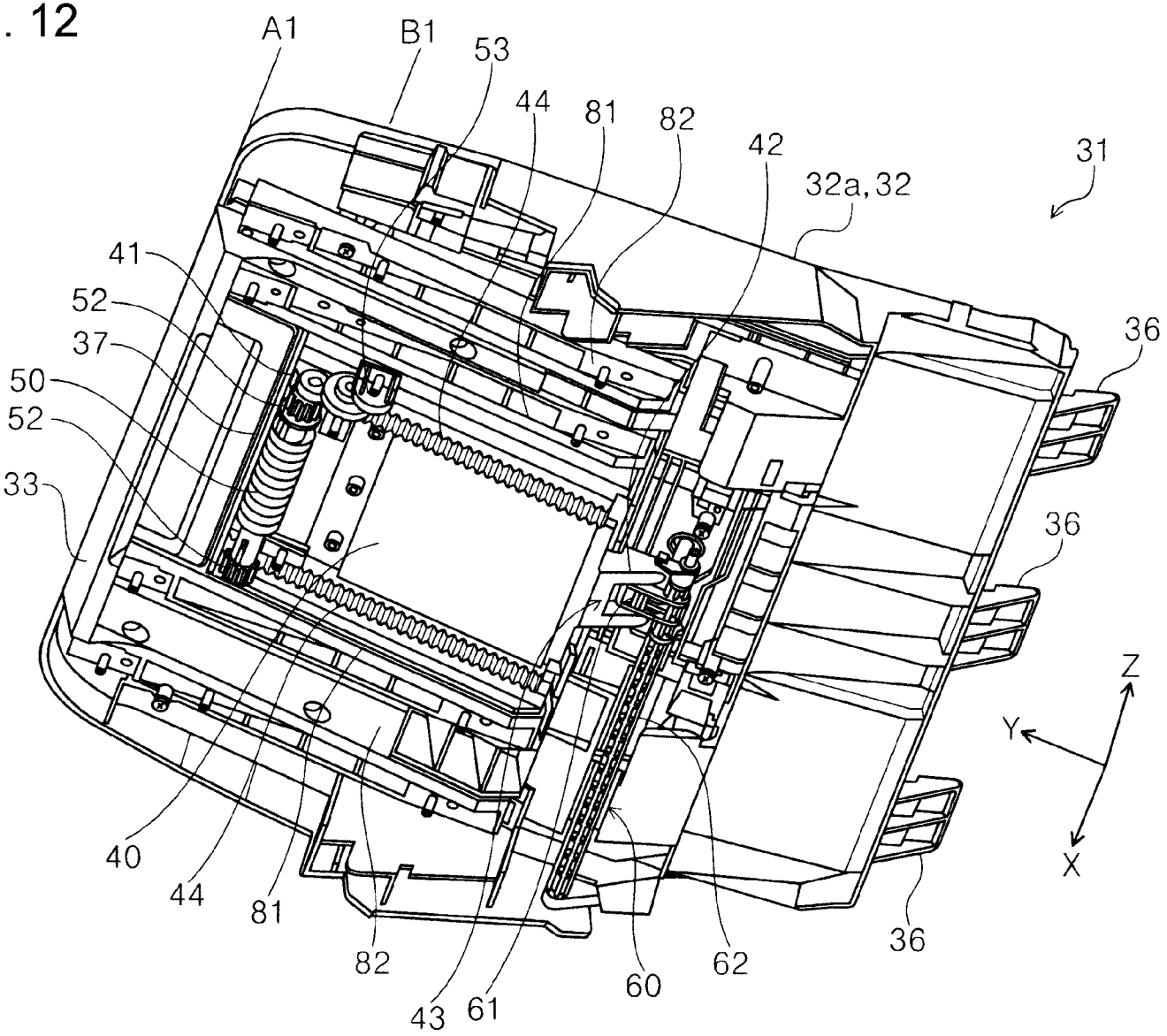
FIG. 12 is a perspective view illustrating the medium receiving portion from which a lower unit has been detached, and illustrates a state in which the second receiving portion is positioned at a retracted position.
Figure 13:
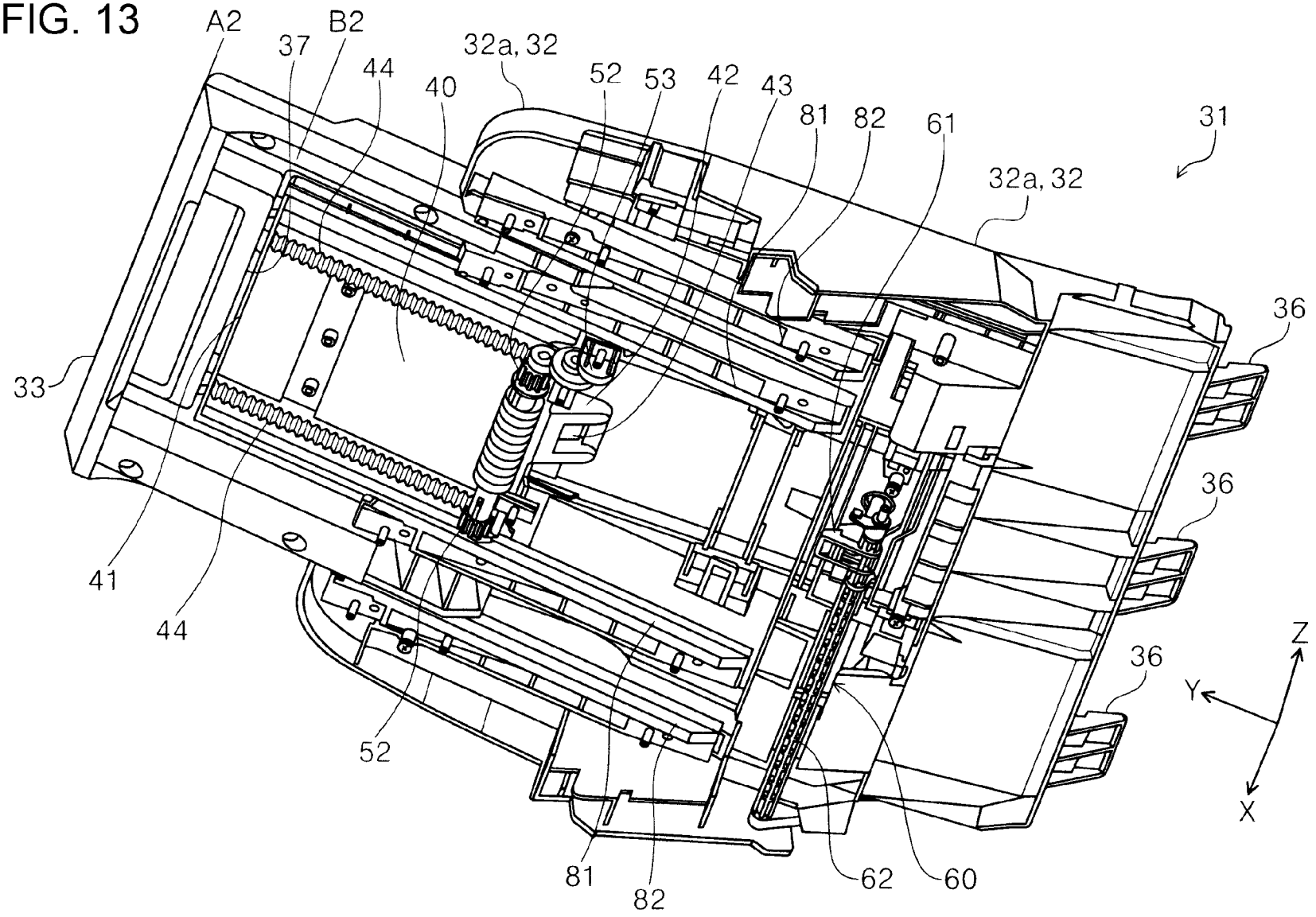
FIG. 13 is a perspective view illustrating the medium receiving portion from which the lower unit has been detached, and illustrates a state in which the second receiving portion pushed by the moving member has been displaced to the advanced position.
Figure 14:
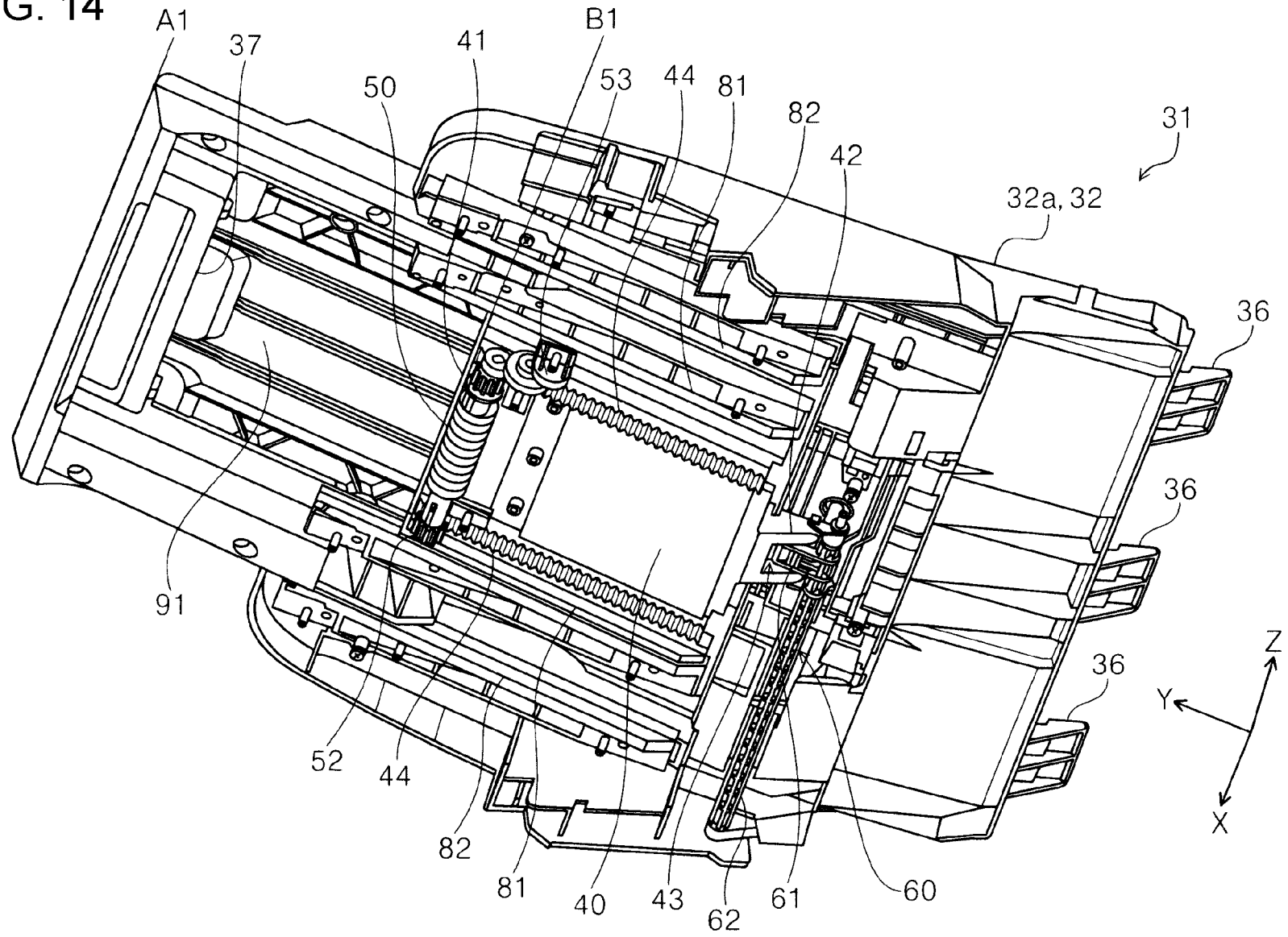
FIG. 14 is a perspective view illustrating the medium receiving portion from which the lower unit has been detached, and illustrates a state in which the second receiving portion pushed by external force other than from the moving member is displaced to the advanced position.

As illustrated in FIG. 12, the displacement mechanism that displaces the second receiving portion 33 from the retracted position A1 to the advanced position A2 includes a moving member 40, a pushing member 50, and a restricting member 60. FIG. 12 illustrates a state in which the lower unit 32*b* of the first receiving portion 32 has been removed from the medium receiving portion 31 in which the second receiving portion 33 is positioned at the retracted position A1. Note that the medium receiving portion 31 illustrated in FIGS. 12 to 14 depicts a state in which the lower unit 32*b* of the first receiving portion 32 has been removed from the medium receiving portion 31.

Regarding Moving Member

Figure 8:
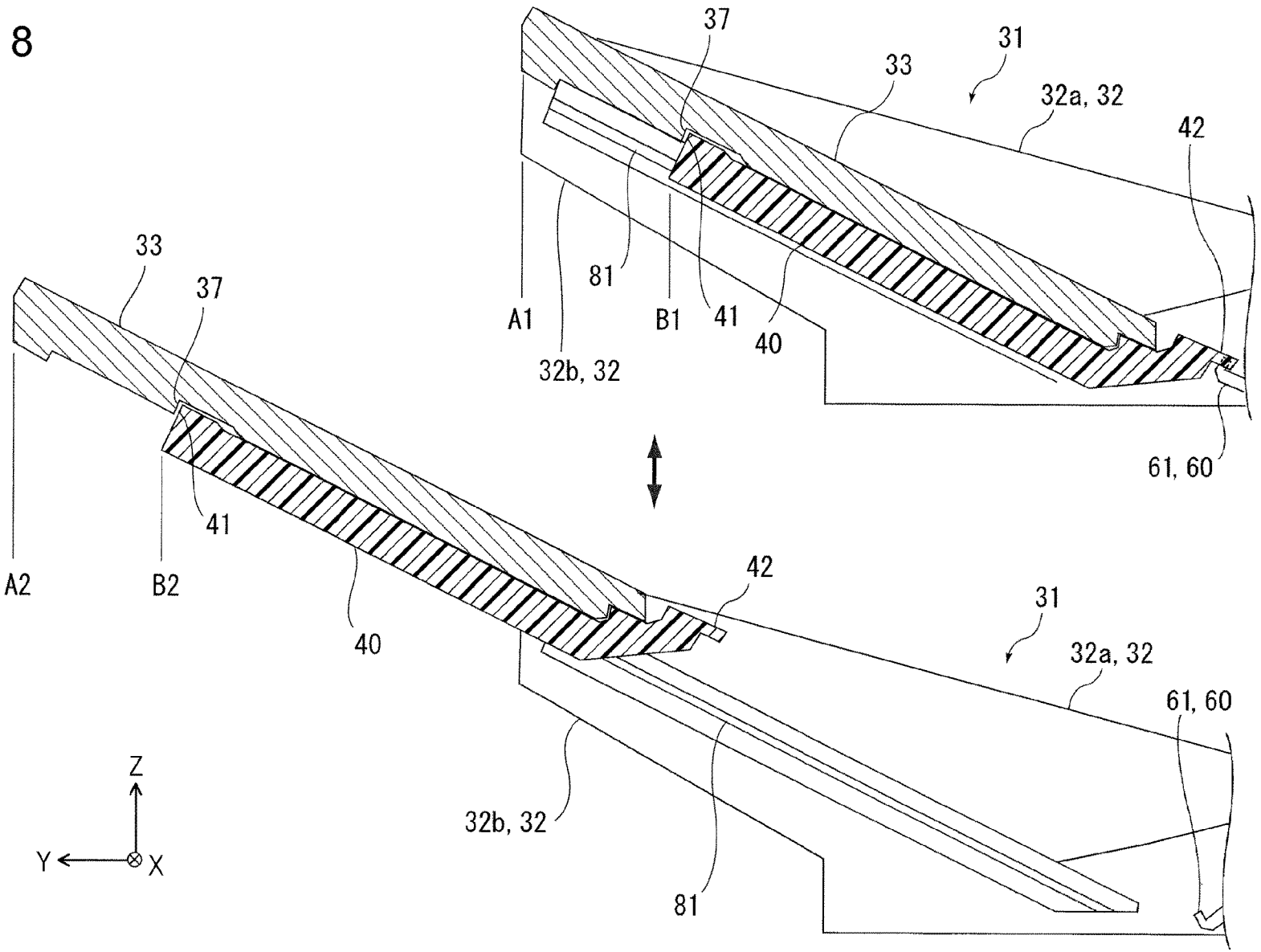
FIG. 8 is a schematic sectional side view illustrating a displacement of the second receiving portion accompanying a movement of a moving member.

The moving member 40 is configured to move between a first position B1 as illustrated in the upper drawing in FIG. 8 and, as illustrated in the lower drawing in FIG. 8, a second position B2 positioned downstream of the first position B1 in the medium discharge direction of the second receiving portion 33, or in the +Y direction. As the moving member 40 moves from the first position B1 towards the second position B2, the moving member 40 abuts against the second receiving portion 33 and pushes the second receiving portion 33 towards the advanced position A2, and as the second receiving portion 33 becomes displaced towards the retracted position A1, the moving member 40 is pushed by the second receiving portion 33 and is moved to the first position B1.

Note that in FIG. 8, the first position B1 and the second position B2 of the moving member 40 are based on the position of the leading end of the moving member 40 in the +Y direction.

As illustrated in FIG. 7, the moving member 40 includes moving-member guide portions 45 and 45 on both sides in the width direction (the X-axis direction), and the moving-member guide portions 45 and 45 guided by moving-member guide rails 81 and 81 disposed inside the second-receiving-portion guide rails 82 and 82 are moved in the Y-axis direction. The second receiving portion 33 and the moving member 40 are guided by separate guide rails (the second-receiving-portion guide rails 82 and 82 and the moving-member guide rails 81 and 81).

More specifically, the moving member 40 includes an abutting portion 41 that abuts against an abutted portion 37 provided in the second receiving portion 33 when moving towards the second position B2, in other words, when moving from the upper drawing to the lower drawing in FIG. 8. In the first position B1 illustrated in the upper drawing in FIG. 8, the abutting portion 41 is positioned immediately behind the abutted portion 37 of the second receiving portion 33 positioned at the retracted position A1.

When the moving member 40 is moved towards the second position B2, the abutting portion 41 abuts against the abutted portion 37 of the second receiving portion 33 and the moving member 40 moves integrally with the second receiving portion 33. In other words, by pushing the second receiving portion 33 from behind with the moving member 40 moving towards the second position B2, the second receiving portion 33 can be displaced in an advancing direction. When the moving member 40 moves to the second position B2, the second receiving portion 33 is displaced to the advanced position A2.

The moving member 40 is moved from the first position B1 to the second position B2 with the pushing force of the pushing member 50.

Regarding Pushing Member

The pushing member 50 pushes the moving member 40 towards the second position B2 illustrated in the lower drawing in FIG. 8. In the present embodiment, a torsion coil spring is used as the pushing member 50. As illustrated in FIG. 7, the pushing member 50 is provided around a coil shaft 51 and is attached on the lower unit 32*b* side. Gears 52 and 52 are provided on both sides of the coil shaft 51. As illustrated in FIGS. 12 and 13, the gears 52 and 52 are meshed with rack portions 44 and 44 provided on an undersurface of the moving member 40 and the pushing force of the pushing member 50 is transmitted to the moving member 40 through the gears 52 and 52.

While the moving member 40 is positioned at the first position B1 illustrated in FIG. 12, the pushing member 50 applies a predetermined pushing force to the moving member 40. When the moving member 40 is positioned at the first position B1, the restricting member 60 described later in detail countering the pushing force of the pushing member 50 restricts the moving member 40 from moving in a direction extending towards the second position B2.

When the restriction of the restricting member 60 is released, as illustrated in FIG. 13, the moving member 40 moves to the second position B2 with the pushing force of the pushing member 50.

Regarding Restricting Member

As illustrated in FIG. 12, the restricting member 60 is, in the −Y direction, provided behind the moving member 40 positioned at the first position B1. The restricting member 60 is configured to switch between a restricting state (FIG. 12) that, while countering the pushing force of the pushing member 50, restricts the movement of the moving member 40 in the direction extending towards the second position B2, and a non-restricting state (FIG. 13) that releases the releasing state.

The restricting member 60 includes a hook portion 61 (also see FIG. 15), and the hook portion 61 is provided on the pivot shaft 62. The pivot shaft 62 is pivotally supported by bearings 63 (see FIG. 10) of the lower unit 32*b*. The restricting state and the non-restricting state of the restricting member 60 are switched by pivoting the pivot shaft 62. As illustrated by a solid line in FIG. 15, when the restricting member 60 is in the restricting state, the hook portion 61 is hooked to a hole portion 43 of a protruding portion 42 provided in an rear end of the moving member 40, and the movement of the moving member 40 in the +Y direction is restricted. Furthermore, when the restricting member 60 is in the non-restricting state, as illustrated by a broken line in FIG. 15, the hook portion 61 is released from the hole portion 43 and the restriction of the movement of the moving member 40 is released. When the restricting member 60 releases the restriction that restricts the moving member 40 from moving in the +Y direction, as illustrated in FIG. 13, the moving member 40 moves to the second position B2 and, with such a movement, the second receiving portion 33 is moved to the advanced position A2.

Figure 16:
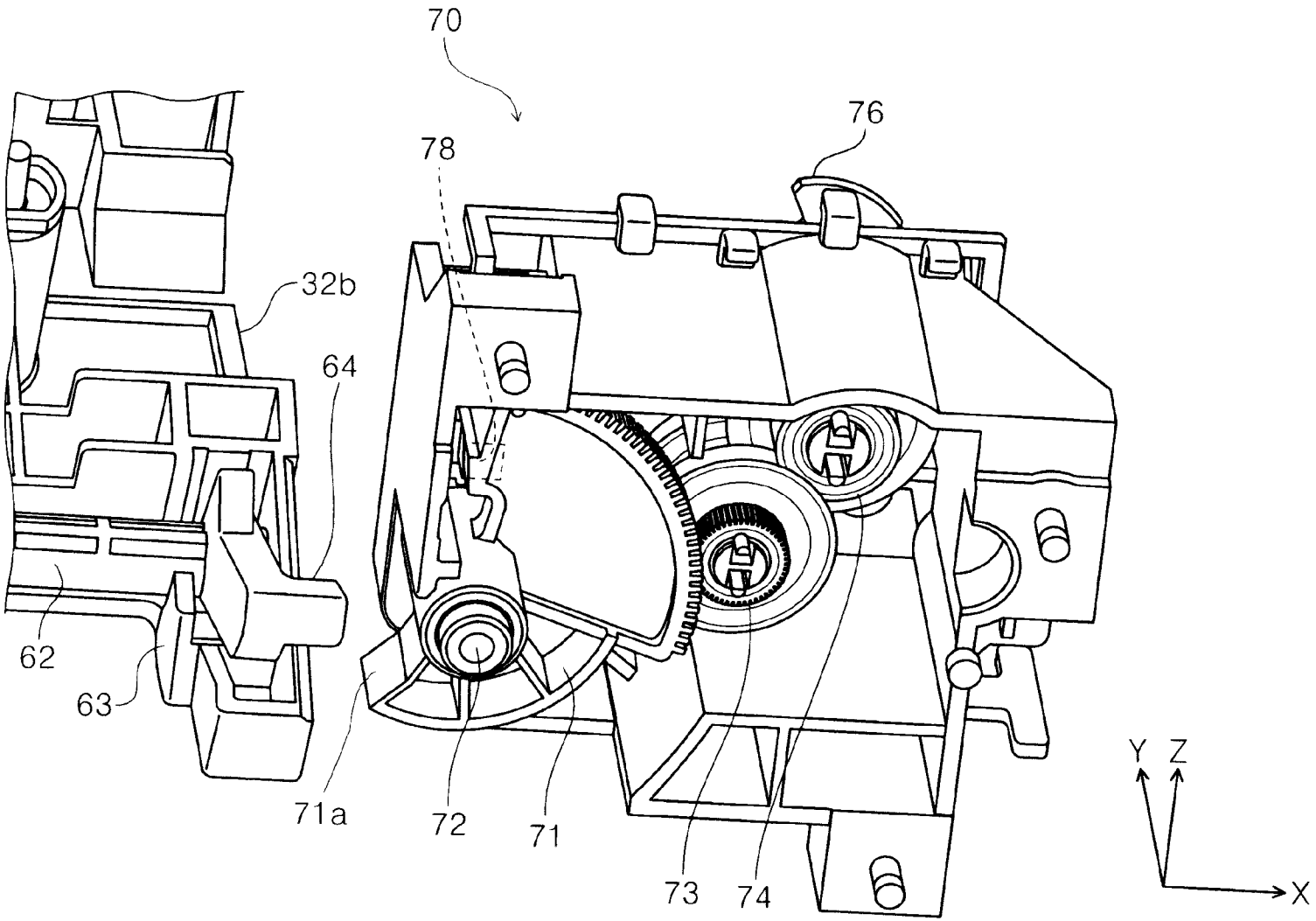
FIG. 16 is an enlarged perspective view of an essential portion in FIG. 9.
Figure 17:
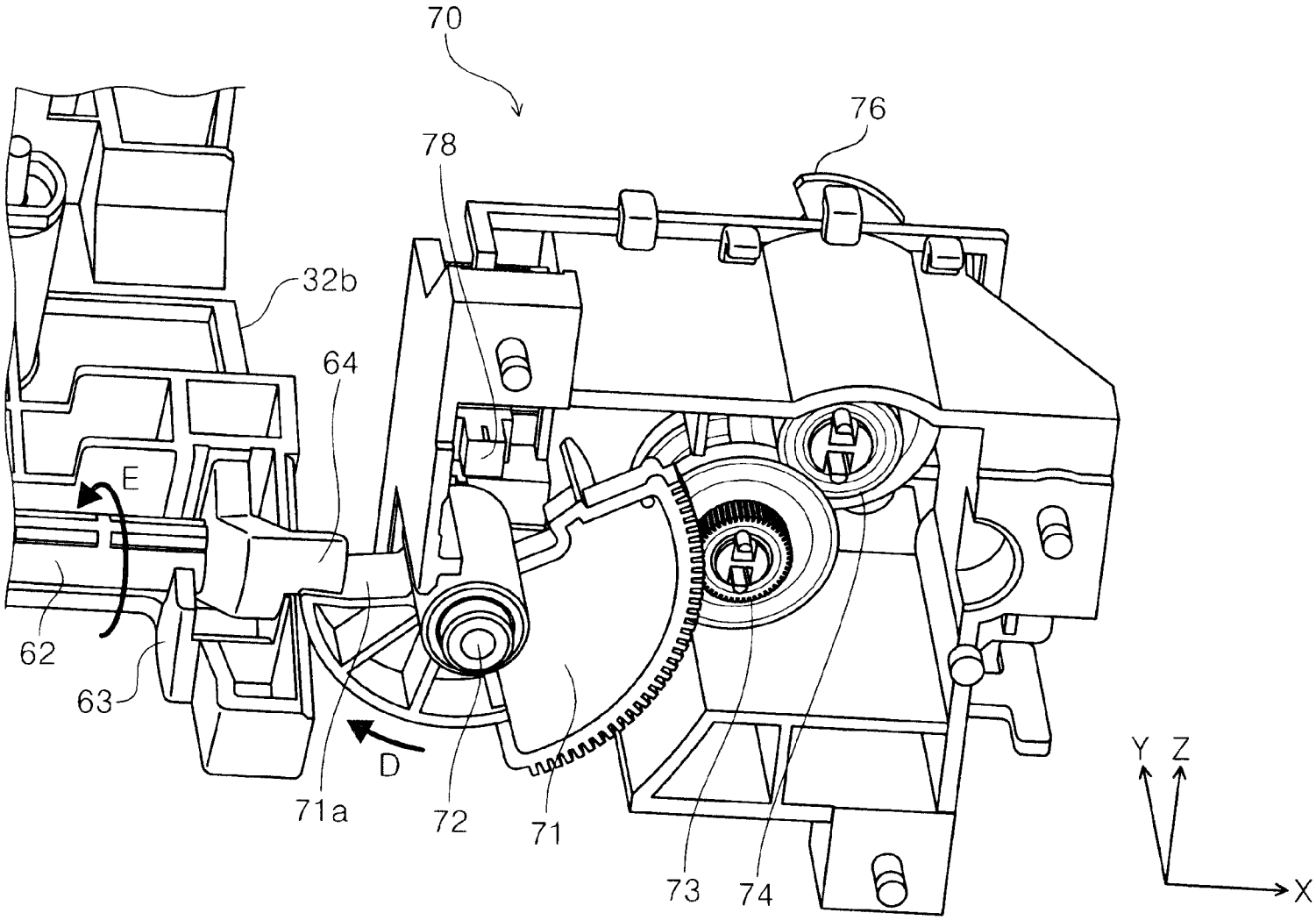
FIG. 17 is an enlarged perspective view of an essential portion in FIG. 10.

Pivoting of the pivot shaft 62 is performed with a drive mechanism 70 illustrated in FIGS. 9 and 10. The drive mechanism 70 is provided in the apparatus body unit 2, which is not shown in FIGS. 9 and 10. In the present embodiment, the drive mechanism 70 is disposed on the +X side of the medium receiving portion 31. FIGS. 16 and 17 are enlarged views of a portion around the drive mechanism 70 in FIGS. 9 and 10.

Figure 15:
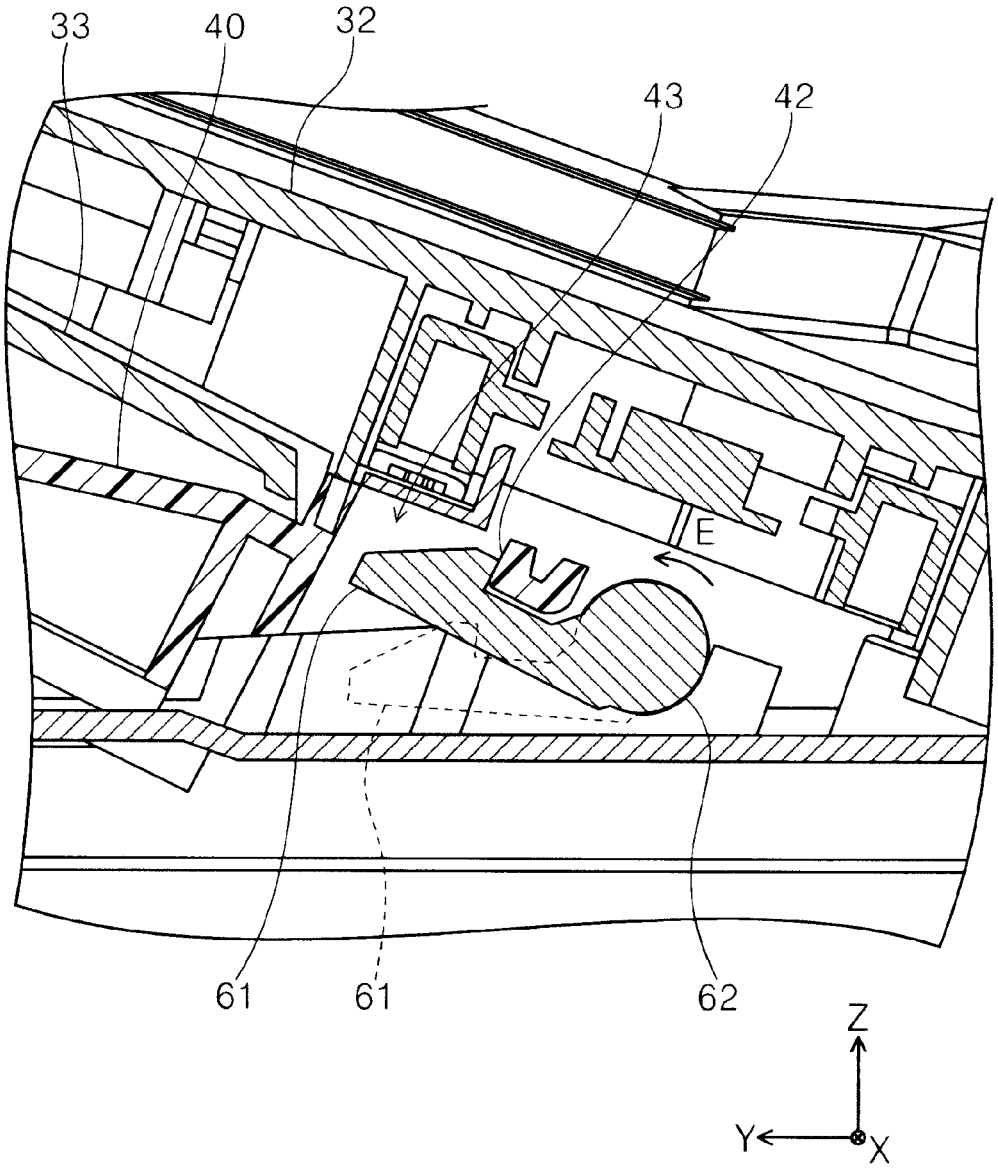
FIG. 15 is an enlarged sectional side view of a portion around a restricting member.

The pivot shaft 62 is pushed by the pushing member (not shown) in a direction in which the hook portion 61 (the restricting member 60) is pivoted from the non-restricting state illustrated by the broken line in FIG. 15 towards the restricting state illustrated by a solid line. FIG. 16 corresponds to FIG. 9 and is a drawing illustrating a state in which the hook portion 61 is in the restricting state. A lever 64 is provided in the end portion of the pivot shaft 62 in the +X direction. When the hook portion 61 is in the restricting state, the lever 64 is separated from a lever contact portion 71*a* of a cam gear 71 of the drive mechanism 70.

Figure 18:
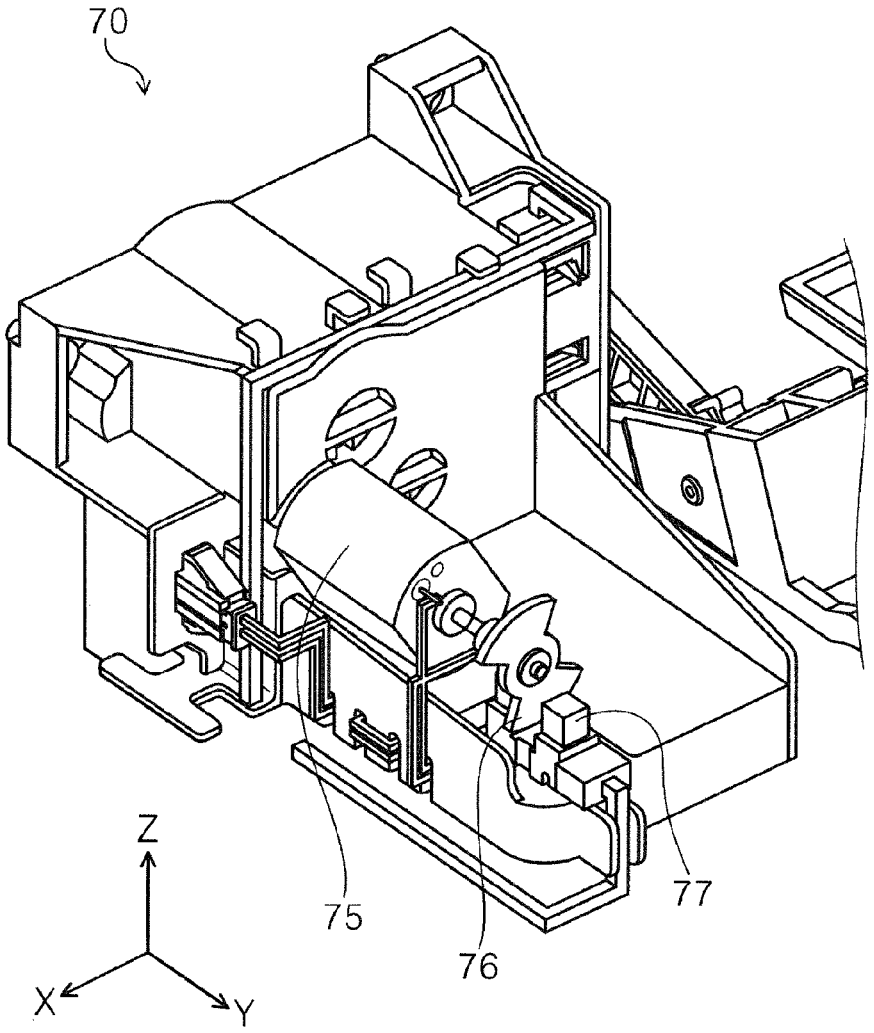
FIG. 18 is a perspective view viewing FIG. 16 from a different angle.

The cam gear 71 pivots about a rotation shaft 72 with motive power of a motor 75 illustrated in FIG. 18. As illustrated in FIG. 17, when the cam gear 71 pivots in an arrow D direction, the lever contact portion 71*a* of the cam gear 71 pushes the lever 64 up and, with the above, the pivot shaft 62 countering the pushing force of the pushing member (not shown) is pivoted in an arrow E direction (also see FIG. 15). With the above, the hook portion 61 can be set to the non-restricting state from the restricting state. The drive mechanism 70 is controlled with the control unit 21 illustrated in FIG. 2 and, accordingly, the operation of the restricting member 60 is controlled. In other words, the control unit 21 in the present embodiment is a "restricting member control unit" that controls the operation of the restricting member 60.

The drive mechanism 70 illustrated in FIGS. 16 and 17 includes a first gear 74 attached to a rotation shaft of the motor 75 (FIG. 18), and a second gear 73 disposed between the first gear 74 and the cam gear 71. The motor 75 illustrated in FIG. 18 is configured so that the rotation phase is detected by a scale 76 and an encoder 77.

Furthermore, as illustrated in FIG. 17, the drive mechanism 70 includes a cam detection portion 78 that detects the position of the cam gear 71. An optical sensor, for example, can be used as the cam detection portion 78. As illustrated in FIG. 16, when the cam gear 71 covers the cam detection portion 78 and the cam detection portion 78 detects the cam gear 71, the cam gear 71 is positioned in such a manner that the lever contact portion 71*a* is away from the lever 64. As illustrated in FIG. 17, when the cam gear 71 becomes undetected by the cam detection portion 78, the cam gear 71 is positioned in such a manner that the lever contact portion 71*a* pushes up the lever 64.

The detection of the lever 64 being pushed up and the hook portion 61 (the restricting member 60) being set to the non-restricting state can be detected by detecting the position of the cam gear 71 with the cam detection portion 78. The second receiving portion 33 that is displaced in the above manner with the moving member 40, the pushing member 50, and the restricting member 60 can be displaced to the advanced position A2 automatically according to the length of the medium P discharged to the medium receiving portion 31.

Furthermore, in the medium discharging apparatus 30, when the length of the medium P, which has been acquired by the operation unit 4 (FIG. 2) serving as the medium length acquiring member 35, is equivalent to or larger than a predetermined length, the control unit 21 (the restricting member control unit) releases the restriction of the restricting member 60, moves the moving member 40 to the second position B2 with the pushing force of the pushing member 50, and displaces the second receiving portion 33 to the advanced position A2. The operation described above in which the second receiving portion 33 is displaced to the advanced position A2 with the movement of the moving member 40 to the second position B2 will be referred to as an "automatically advancing operation" hereinafter.

Based on information of the size of the medium P input through the operation unit 4, the control unit 21 controls the drive mechanism 70 (FIG. 9) according to the size of the medium P and switches between the restricting state (the solid line in FIG. 15) and the non-restricting state (the broken line in FIG. 15) of the restricting member 60. With the above, the length of the medium receiving portion 31 can be changed according to the size of the medium P discharged from the medium discharging apparatus 30.

Other than using the control unit 21 that acquires the settings input to the operation unit 4, the medium length acquiring member 35 may, as illustrated in FIG. 2, be configured to acquire the length of the transported medium P using a medium sensor 22 provided in the medium transport path T1, for example.

Furthermore, the second receiving portion 33 is disposed in front (in the +Y direction) of the moving member 40 and is, as illustrated in FIG. 7, configured to advance and retract in the Y-axis direction by having the second-receiving-portion guide portions 38 and 38 be guided by the second-receiving-portion guide rails 82 and 82, which is different from the moving-member guide rails 81 and 81. Furthermore, the second receiving portion 33 can be displaced from the retracted position A1 to the advanced position A2 while the second receiving portion 33 leaving the moving member 40, the movement of which is restricted by the restricting member 60 as illustrated in FIGS. 11 and 14, at the first position B1 is operated manually.

In other words, an external force can be applied to the second receiving portion 33 so that the second receiving portion 33 is displaced to the advanced position A2 independent of the moving member 40. Note that the operation described above in which the second receiving portion 33 is displaced to the advanced position A2 by receiving external force other than that of the moving member 40 would be referred to as a "passively advanced operation" hereinafter.

Since a drive system such as a motor is not directly coupled to the second receiving portion 33, the operation feeling during the operation of the "passively advanced operation" in which the user manually moves the second receiving portion 33 can be light and favorable.

Figure 22:
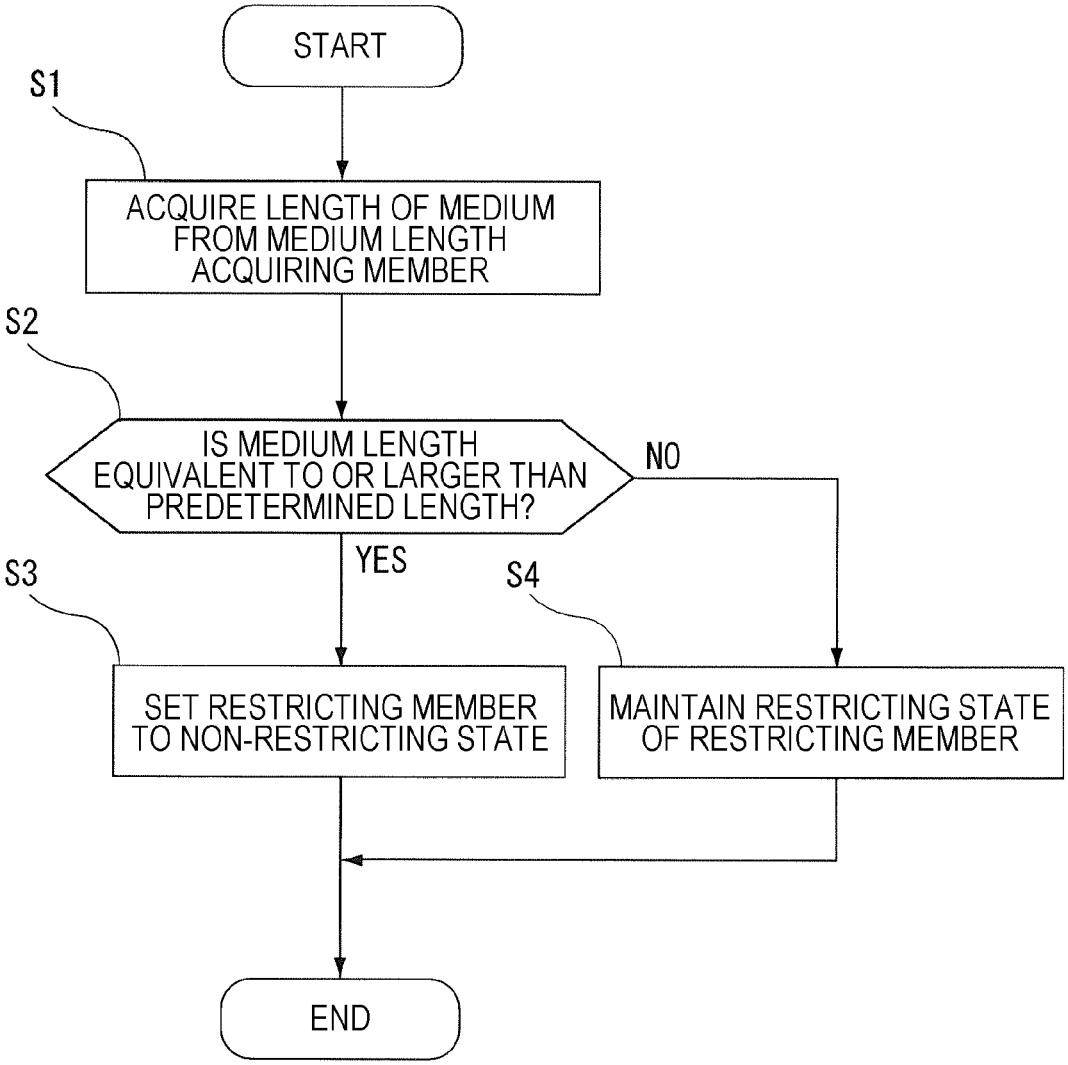
FIG. 22 is a flowchart illustrating a control performed by a control unit.

Referring to FIG. 22, a control performed by the control unit 21 will be described. In step S1, the control unit 21 acquires the length of the medium P from the medium length acquiring member 35 (the operation unit 4). In step S2, determination is made on whether the length of the medium P is equivalent to or larger than a predetermined length. When the length of the medium P is equivalent to or larger than the predetermined length, in other words, when it is YES in step S2, the process proceeds to step S3 and the restricting member 60 is set to the non-restricting state to push the second receiving portion 33 with the moving member 40 and displace the second receiving portion 33 to the advanced position A2. On the other hand, when the length of the medium P is shorter than the predetermined length, in other words, when it is NO in step S2, the process proceeds to step S4 and the restricting member 60 is maintained so as to be in the restricting state. The "automatically advancing operation" in which the second receiving portion 33 is, in accordance with the length of the medium P, displaced to the advanced position A2 can be performed with the above control.

With the configuration of the medium discharging apparatus 30 described above, the "automatically advancing operation" that is performed automatically according to the size of the medium P, and the "passively advanced operation" that is performed manually by the user can both be achieved with suitable operability. Accordingly, usability of the medium discharging apparatus 30 for the user can be improved.

Note that in the present embodiment, the second receiving portion 33 is moved from the advanced position A2 to the retracted position A1 by applying external force to the second receiving portion 33 in the −Y direction. As illustrated in FIG. 13, when the second receiving portion 33 is displaced to the advanced position A2 with the "automatically advancing operation", the moving member 40 is also returned to the first position B1 in an integral manner with the second receiving portion 33 returning to the retracted position A1. As illustrated in FIG. 14, when the second receiving portion 33 is displaced to the advanced position A2 with the "passively advanced operation", the second receiving portion 33 alone is returned to the retracted position A1.

Other Configurations of Medium Discharging Apparatus

A buffer mechanism 53 (FIGS. 7 and 12) that reduces the displacement speed of the second receiving portion 33 displaced to the advanced position A2 with the "automatically advancing operation" can be provided in the medium discharging apparatus 30. The buffer mechanism 53 may be referred to as a damper. A friction clutch that is coupled to the gear 52 and that reduces the rotating speed of the gear 52 is used as the buffer mechanism 53 in the present embodiment.

By providing the buffer mechanism 53, the second receiving portion 33 can be displaced slowly in the advancing direction during the automatically advancing operation that displaces the second receiving portion 33 with the pushing force of the pushing member 50.

In the present embodiment, between an inclination of the first receiving portion 32 and an inclination of the second receiving portion 33, the inclination of the second receiving portion 33 is slightly larger. With the above, even when the auxiliary receiving portion 34 is not in the erect state, for example, the medium P can be prevented from popping out in the discharge direction due to the momentum when discharged. Accordingly, a stacking performance of stacking the medium P on the medium receiving portion 31 can be improved.

Furthermore, in order to perform the "passively advanced operation" described above, the second receiving portion 33 is configured to move downstream of the moving member 40 in the medium discharge direction when the moving member 40 is at the first position B1. As illustrated in FIG. 11, the moving member 40 includes a contact portion 40*a* that creates a frictional resistance between the second receiving portion 33. An undersurface 91 (FIG. 14) of the second receiving portion 33 is slid in the advancing direction relative to the contact portion 40*a*, which is on an upper surface side of the moving member 40 positioned at the first position B1 by having the movement thereof be restricted by the restricting member 60, and is displaced towards the advanced position A2. The contact portion 40*a* of the moving member 40 is positioned below the second receiving portion 33.

By providing the contact portion 40*a*, when the second receiving portion 33 moves, relative to the moving member 40 at the first position B1, downstream in the medium discharge direction, a frictional resistance is created between the moving member 40 and the second receiving portion 33 so that the second receiving portion 33 is, relative to the moving member 40, suppressed from sliding and moving with momentum.

Furthermore, since the second receiving portion 33 and the moving member 40 are inclined upwards in the advancing direction, there may be cases in which the second receiving portion 33 that has been advanced with the "passively advanced operation" does not stop at the desired position and moves down in the retracting direction due to its own weight.

In the present embodiment, the frictional resistance between the moving member 40 and the second receiving portion 33 is set to a size that stops the second receiving portion 33 at an optional position in the advancing direction with the frictional resistance between the contact portion 40*a*.

Figure 19:
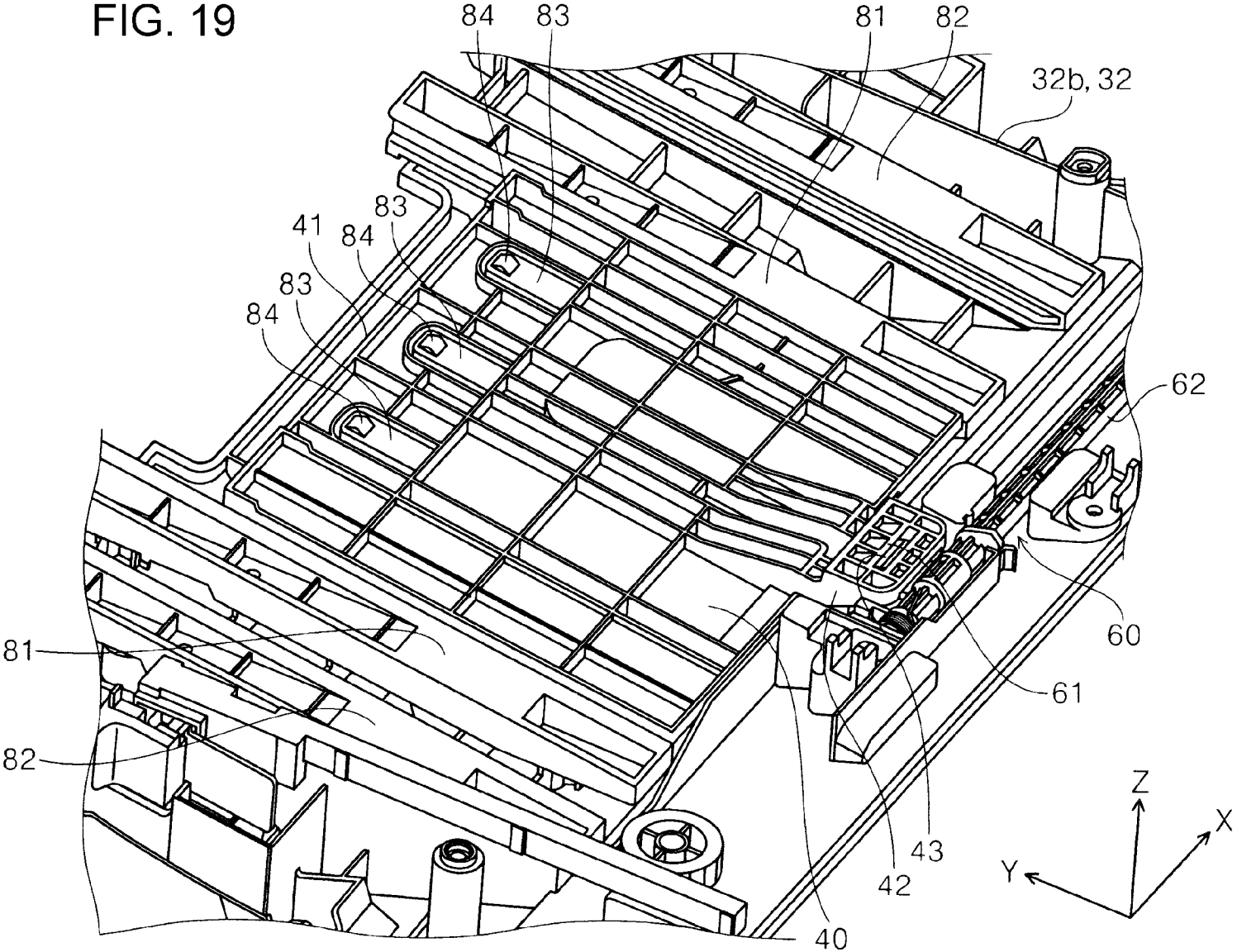
FIG. 19 is a perspective view illustrating the moving member in a restricting state with the restricting member.
Figure 20:
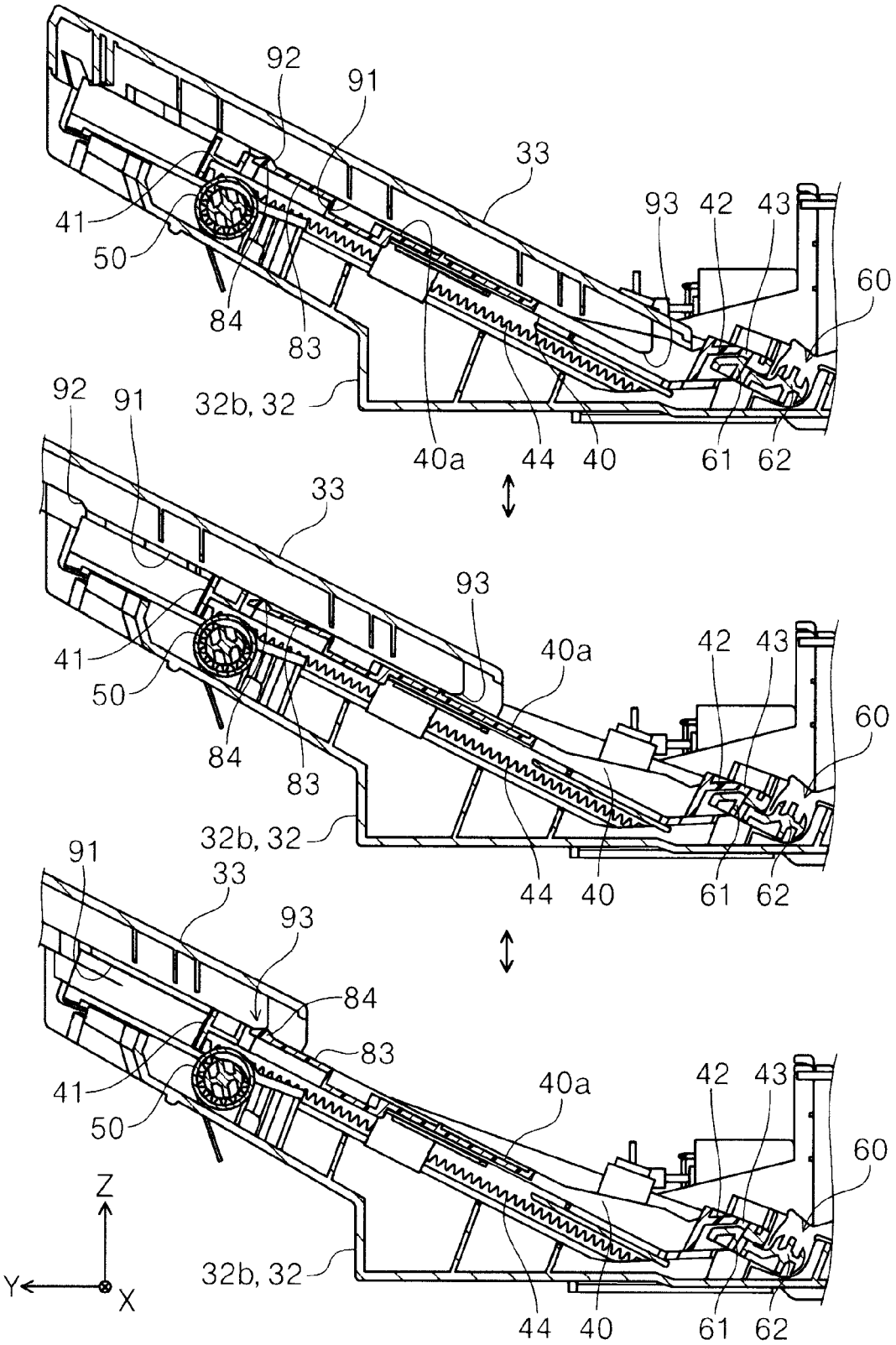
FIG. 20 is a schematic cross-sectional view illustrating a movement of the second receiving portion displaced by a passively advanced operation.

More specifically, as illustrated in FIG. 19, flat springs 83 that generate pushing force in a direction extending towards the second receiving portion 33 that slides over the contact portion 40*a* are provided on the contact portion 40*a* of the moving member 40 (also see the middle drawing in FIG. 20). By providing the flat springs 83, which press the second receiving portion 33, on the contact portion 40*a*, the frictional resistance between the contact portion 40*a* and the second receiving portion 33 is increased and incidents such as the advanced second receiving portion 33 moving down in the retracting direction due to its own weight can be reduced. Furthermore, the amount in which the second receiving portion 33 is advanced can be adjusted optionally.

In the present embodiment, a plurality of flat springs 83 are provided at intervals in the X-axis direction or in the width direction; however, a single flat spring 83 may be provided in the center portion in the width direction. As well as the number of flat springs 83, the contact area between each flat spring 83 and the second receiving portion 33 can be changed.

Mountain portions 84 are provided at leading ends of the flat springs 83. On the other hand, first step portions 92 that receive the mountain portions 84 when the second receiving portion 33 is at the retracted position A1 illustrated in the upper drawing in FIG. 20 are provided in the lower portion of the second receiving portion 33. The first step portions 92 are steps that are lower than the undersurface 91 that slides against the contact portion 40*a*. By having the mountain portions 84 of the flat springs 83 be fitted in the first step portions 92 in the second receiving portion 33 at the retracted position A1 (the upper drawing in FIG. 20), unintentional displacement of the second receiving portion 33 from the retracted position A1 can be suppressed. Furthermore, when the displacement of the second receiving portion 33 from the advanced position A2 (the lower drawing in FIG. 20) to the retracted position A1 is completed, a sensation of the mounting portions 84 being fitted into the first step portions 92 can be obtained as a click feeling; accordingly, the displacement of the second receiving portion 33 to the retracted position A1 can be performed reliably.

Furthermore, second step portions 93 that receive the mounting portions 84 when the second receiving portion 33 is at the advanced position A2 illustrated in the lower drawing in FIG. 20 are provided in the lower portion of the second receiving portion 33. The second step portions 93 are also steps that are lower than the undersurface 91 that slides against the contact portion 40*a*. By having the mounting portions 84 of the flat springs 83 be fitted in the second step portions 93 in the second receiving portion 33 at the advanced position A2 (the lower drawing in FIG. 20), the second receiving portion 33 can be suppressed from being displaced in the retracting direction from the advanced position A2. Furthermore, when the displacement of the second receiving portion 33 to the advanced position A2 is completed, a sensation of the mounting portions 84 being fitted into the second step portions 93 can be obtained as a click feeling; accordingly, the displacement of the second receiving portion 33 to the advanced position A2 can be performed reliably.

Regarding the flat springs 83, flat springs 83 formed of a metal material can be retrofitted to the moving member 40 formed of a resin material, for example. Furthermore, the flat springs 83 can be integrally formed together with the moving member 40 with a resin material.

Modification Example of Restricting Member

Figure 21:
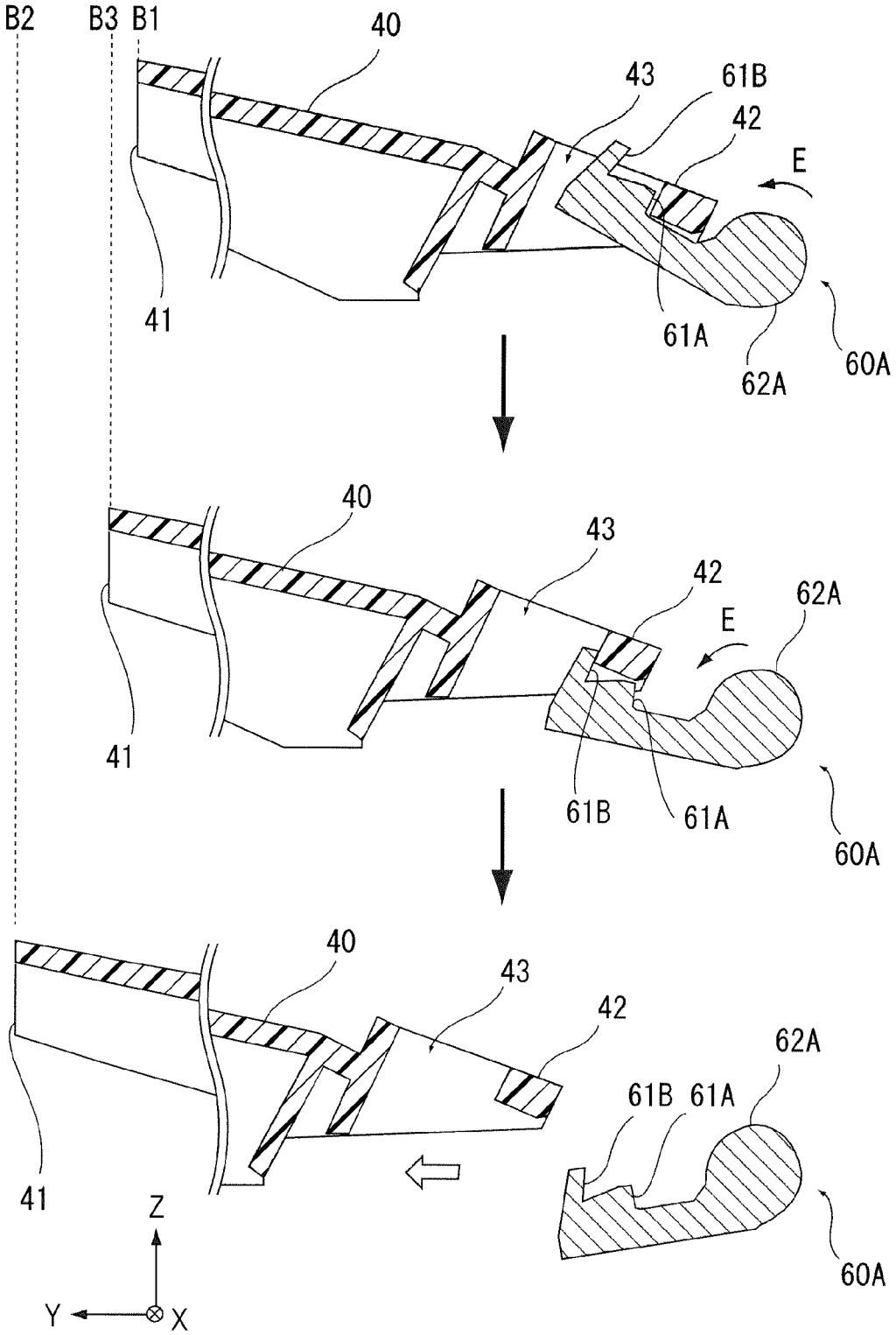
FIG. 21 is a diagram illustrating a modification of the restricting member.

Referring to FIG. 21, a description of a restricting member 60A that is a modification of the restricting member 60 will be given.

The restricting member 60A is configured to switch between, as illustrated in the upper drawing in FIG. 21, a first restricting state that restricts the moving member 40 at the first position B1 and, as illustrated in the middle drawing in FIG. 21, a second restricting state that restricts the moving member 40 at a downstream position B3 that is closer to the second position B2 than the first position B1.

The restricting member 60A includes a first hook portion 61A and a second hook portion 61B that are formed as two steps. The first hook portion 61A has a shape corresponding to that of the hook portion 61 illustrated in FIG. 15 and, as illustrated in the upper drawing in FIG. 21, when the first hook portion 61A is hooked to the hole portion 43 of the moving member 40, the moving member 40 is positioned at the first position B1.

The second hook portion 61B is provided at a position farther away from a pivot shaft 62A than the first hook portion 61A. As illustrated in the middle drawing in FIG. 21, when the pivot shaft 62A is slightly rotated in the arrow E direction, the first hook portion 61A is released from the hole portion 43 and the restriction imposed by the first hook portions 61A restricting the movement of the moving member 40 is released; accordingly, the moving member 40 moves in the +Y direction. While the moving member 40 is moving slightly in the +Y direction, when the second hook portion 61B becomes hooked to the hole portion 43, the movement of the moving member 40 in the +Y direction becomes restricted. With the above configuration, the moving member 40 can be restricted at the downstream position B3 that is closer to the second position B2 than the first position B1.

As illustrated in the lower drawing in FIG. 21, when the pivot shaft 62A is further rotated in the arrow E direction, the second hook portion 61B is released from the hole portion 43 and the moving member 40 moves to the second position B2.

As described above, by using the restricting member 60A and that includes the first hook portion 61A and the second hook portion 61B formed as two steps, the moving member 40 can be stopped at a position between the first position B1 and the second position B2. Accordingly, the second receiving portion 33 (not shown in FIG. 21) can be advanced in a stepwise manner in the "automatically advancing operation". The number of steps of the hook portion is not limited to two. It goes without saying that the number of steps can be three or more.

Note that whether to perform the "automatically advancing operation" can be set through an input to the operation unit 4. In a case in which discharging of the medium P is preformed after setting the mode to not performing the "automatically advancing operation", when the length of the medium P acquired by the medium length acquiring member 35 is equivalent to or larger than the predetermined length, an alert, for example, notifying the user that the size of the medium P is the size to perform the "automatically advancing operation" is, desirably, issued. In such a case, the user may be allowed to select once more whether the "automatically advancing operation" is to be performed.

Furthermore, a tray position detection member that detects the position of the second receiving portion 33 can be provided in the medium discharging apparatus 30.

Furthermore, the pushing member 50 is not limited to a configuration using a torsion coil spring and, for example, a compression spring that stretches in the moving direction of the moving member 40 can be used.

Modification of Buffer Mechanism

Hereinafter, descriptions of first to third modifications that are modifications of the buffer mechanism 53 illustrated in FIGS. 7, 12, and 13 will be given.

Figure 24:
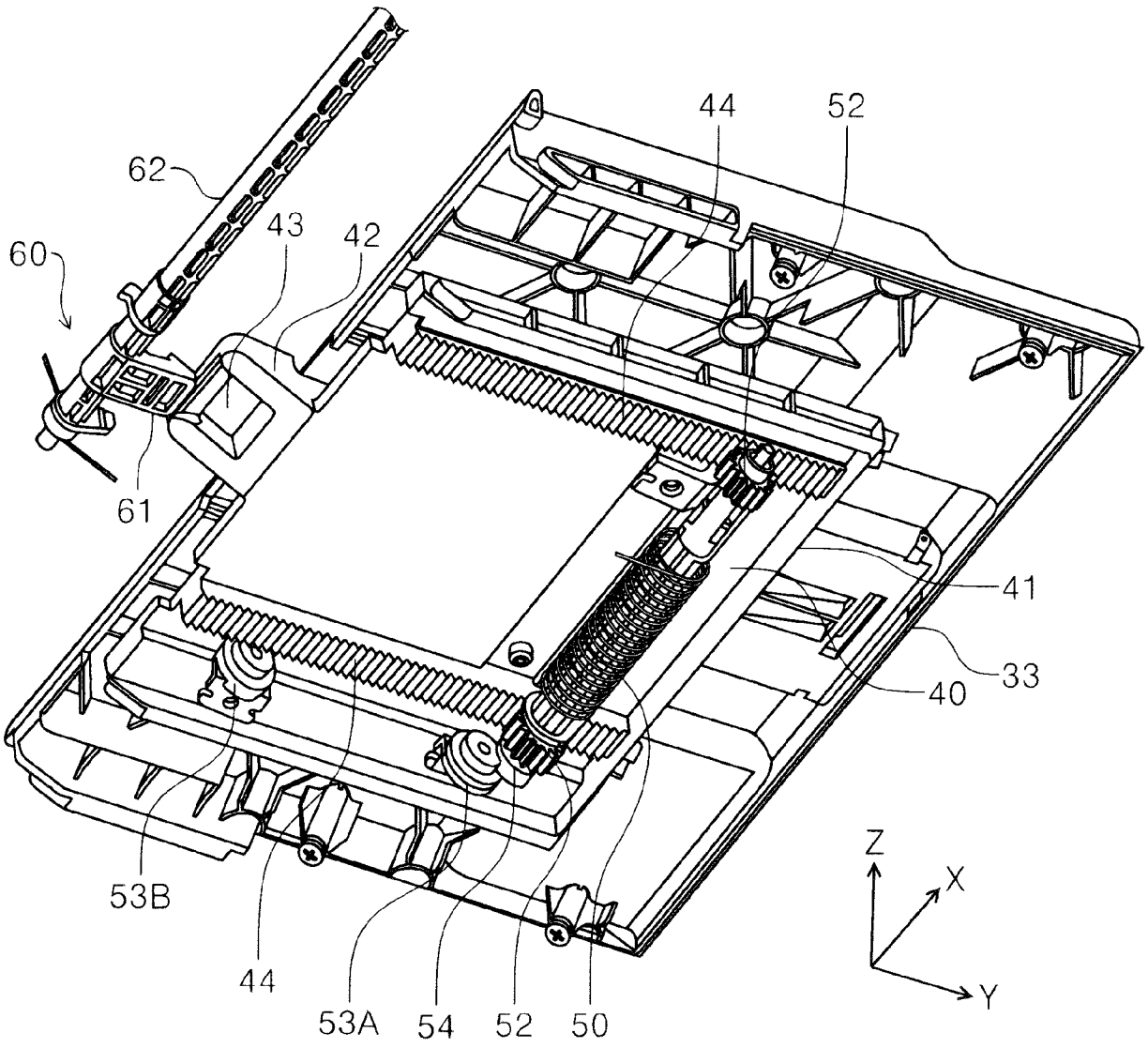
FIG. 24 is a diagram illustrating the first modification of the buffer mechanism and is a perspective view illustrating a state in which the moving member has moved towards the advanced position from the retracted position.
Figure 25:
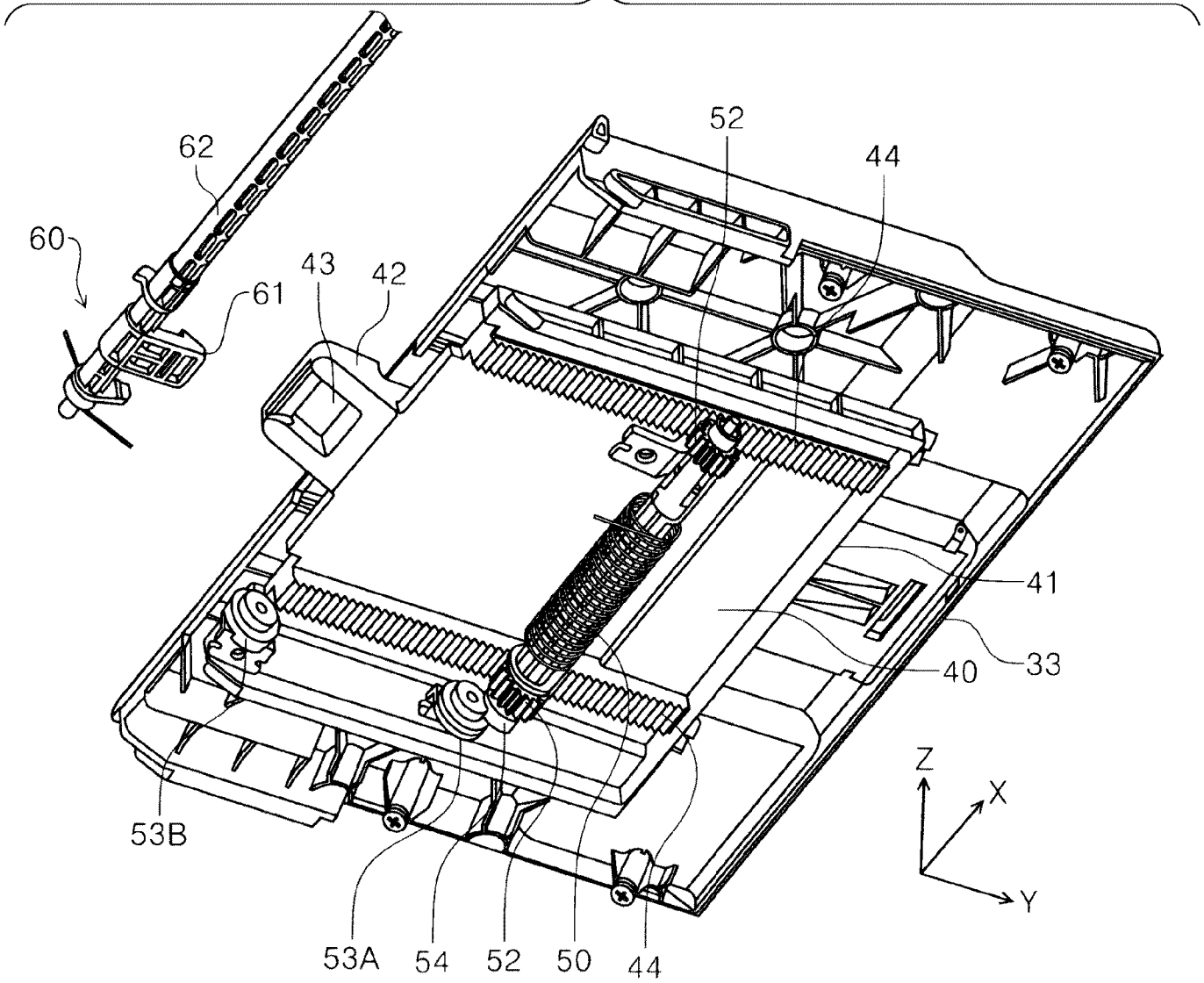
FIG. 25 is a diagram illustrating the first modification of the buffer mechanism and is a perspective view illustrating a state in which the moving member has further moved towards the advanced position from the retracted position.
Figure 26:
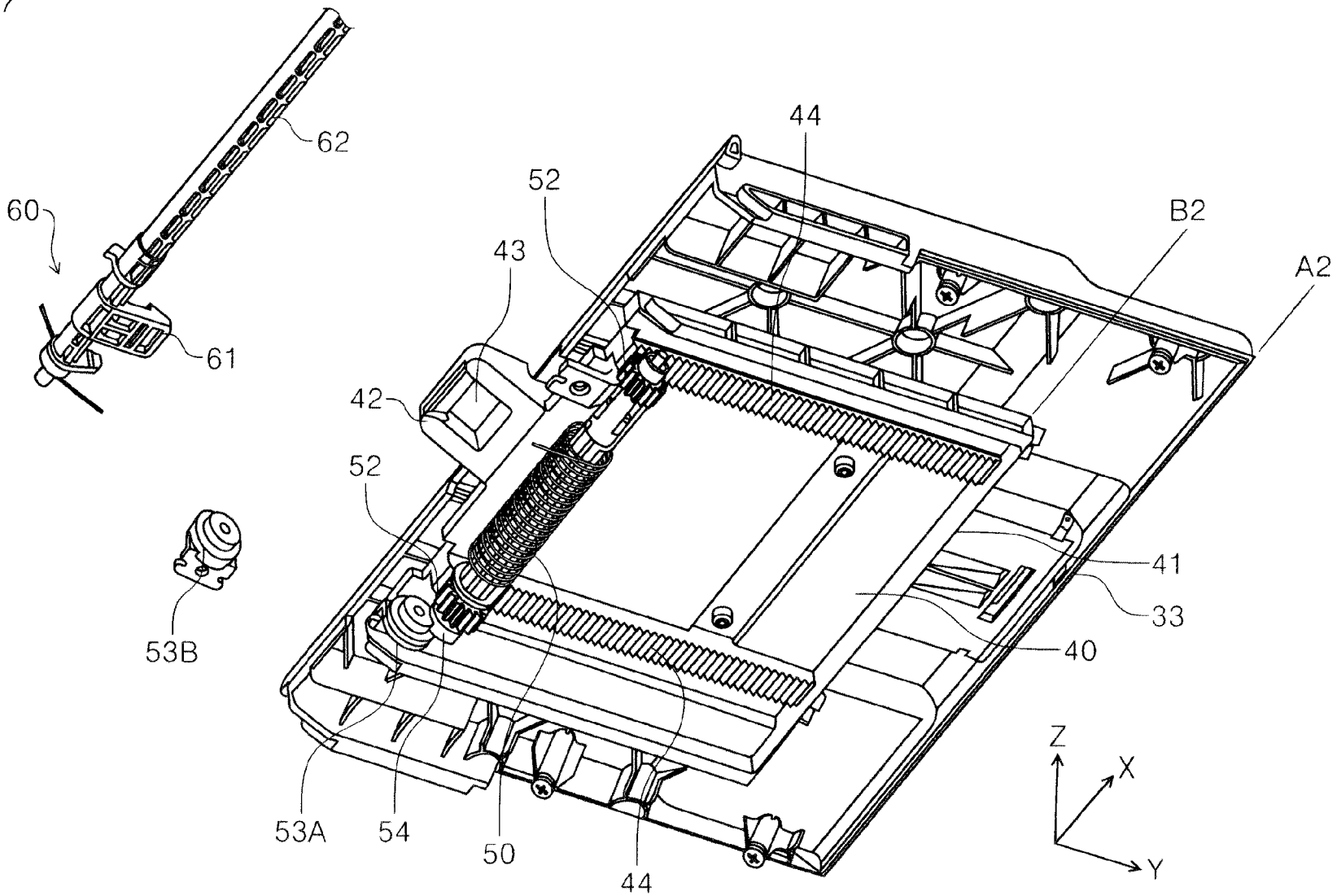
FIG. 26 is a diagram illustrating the first modification of the buffer mechanism and is a perspective view illustrating a state in which the moving member has moved to the advanced position.
Figure 27:
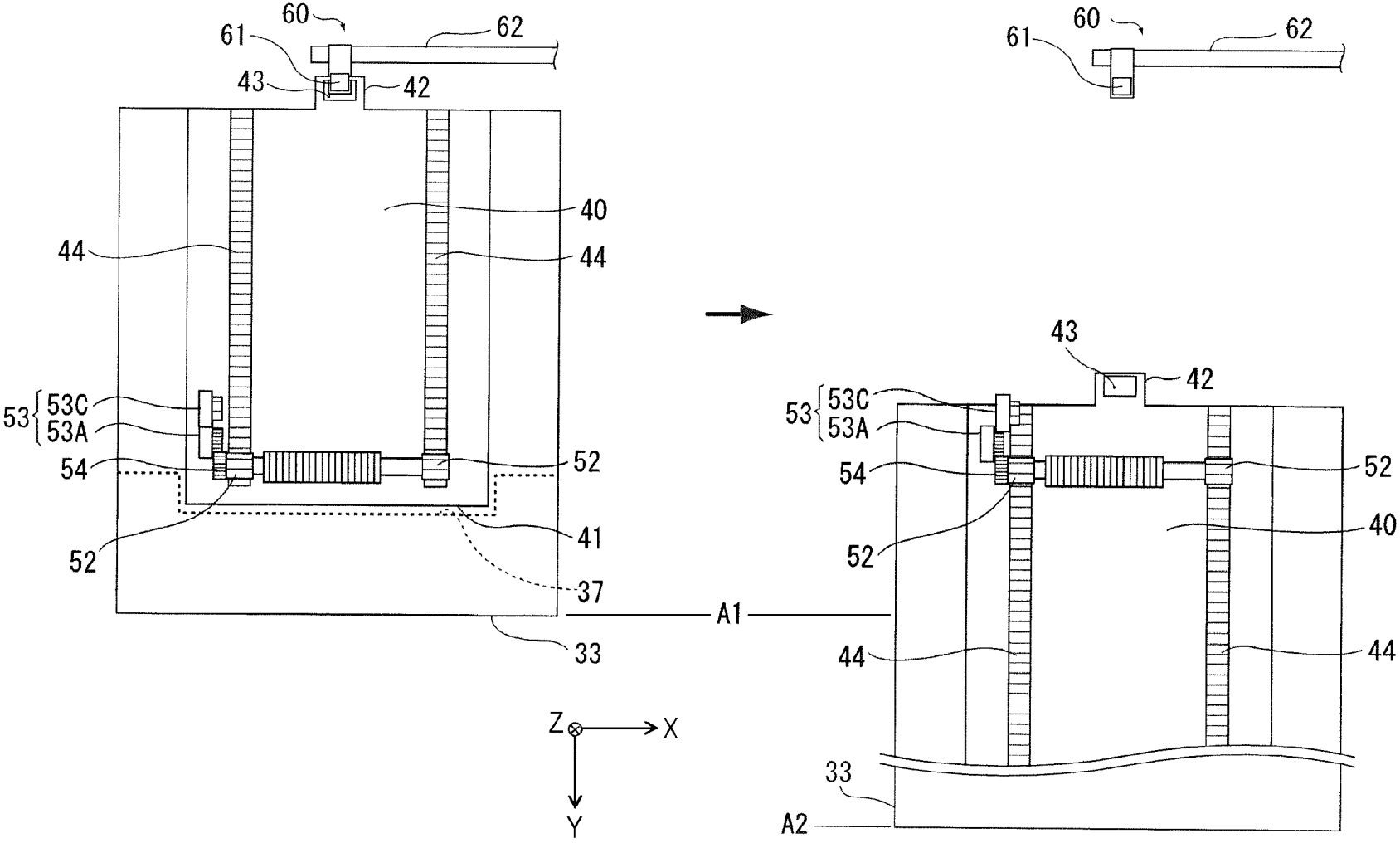
FIG. 27 is a diagram illustrating a second modification of the buffer mechanism.
Figure 28:
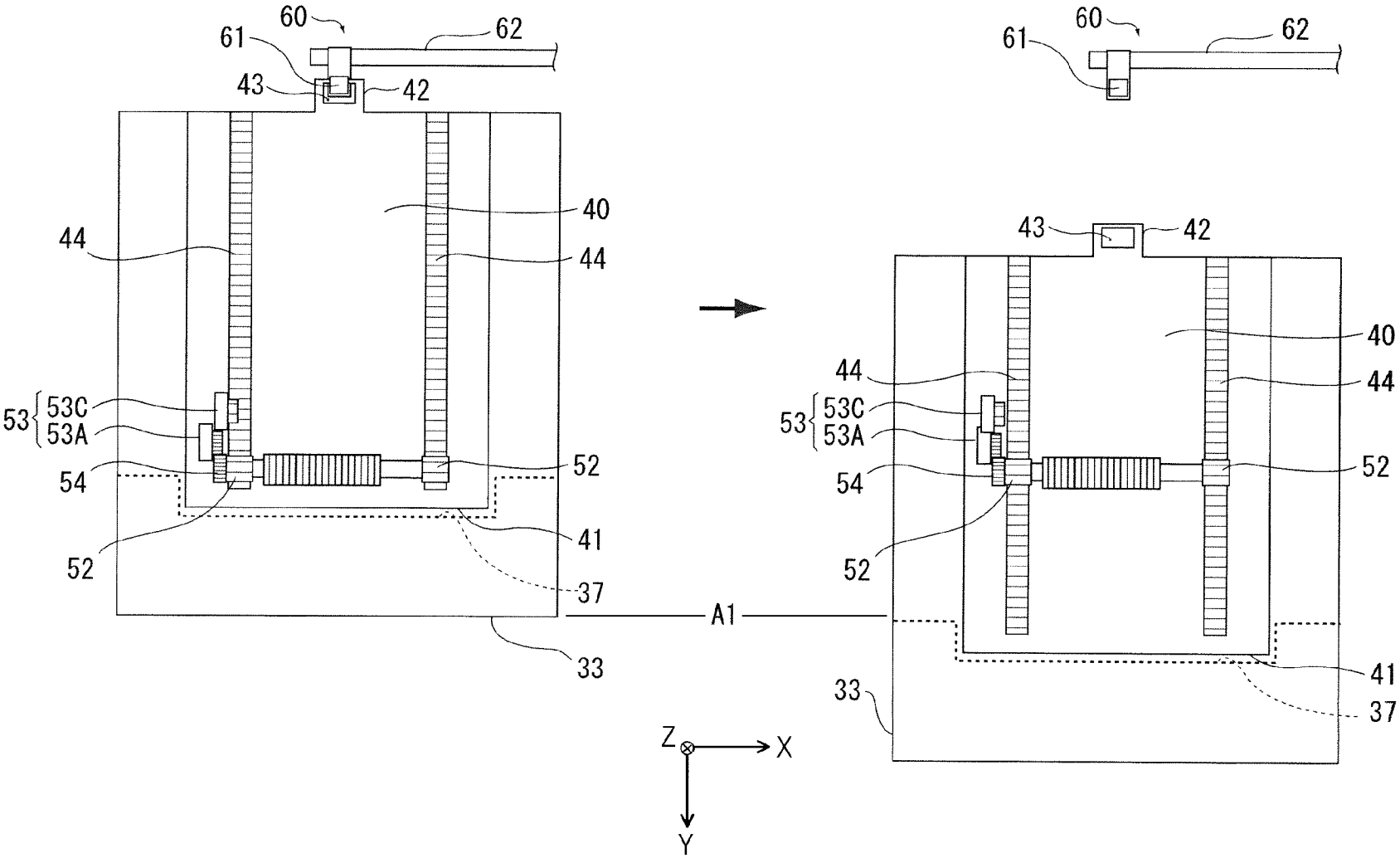
FIG. 28 is a diagram illustrating a third modification of the buffer mechanism.

In the first modification illustrated in FIGS. 23 to 26, the second modification illustrated in FIG. 27, and the third modification illustrated in FIG. 28, a plurality of buffer mechanisms 53 are provided so as to be arranged in the Y-axis direction that is the moving direction of the second receiving portion 33, and the number of buffer mechanisms 53 acting on the second receiving portion 33 changes as the second receiving portion 33 moves from the retracted position A1 (FIG. 23) towards the advanced position A2 (FIG. 26).

As in the present embodiment, in a case in which a torsion coil spring is used as the pushing member 50, when the second receiving portion 33 is displaced from the advanced position A2 (FIG. 26) to the retracted position A1 (FIG. 23) and when the moving member 40 moves from the second position B2 (FIG. 26) to the first position B1 (FIG. 23), the torsion coil spring becomes wound. When the restriction of the hook portion 61 of the restricting member 60 on the moving member 40 is released, the winding force of the torsion coil spring serving as the pushing member 50 is released and pushing force is applied to the moving member 40. Note that the pushing force exerted by the torsion coil spring is the largest immediately after the winding force has been released and, gradually converging, becomes smaller.

Accordingly, in a case in which a single buffer mechanism 53 is provided as illustrated in FIGS. 7, 12, and 13, when the decelerating torque of the buffer mechanism 53 is small, the buffer action, in other words, the action of reducing the displacement speed of the second receiving portion 33 may be insufficient and the second receiving portion 33 may pop out with momentum immediately after advancing.

On the other hand, when the decelerating torque of the buffer mechanism 53 is large, the buffer action becomes large; accordingly, while the jumping out of the second receiving portion 33 at the start of advancement can be suppressed, the buffer action against the pushing force of the pushing member 50 that gradually becomes smaller may be excessive and may lead to a state in which the advancement of the second receiving portion 33 is not completed before the discharge of the medium.

The degree of buffer action that the second receiving portion 33 receives while the second receiving portion 33 moves towards the advanced position A2 from the retracted position A1 can be changed with a configuration in which the number of buffer mechanisms 53 acting on the second receiving portion 33 changes as the second receiving portion 33 advances. Accordingly, the speed at which the second receiving portion 33 advances can be adjusted. Hereinafter, detailed descriptions will be given in the order of the first modification, the second modification, and the third modification.

Referring first to FIGS. 23 to 26, a description of the first modification will be given.

In the first modification, as the second receiving portion 33 moves from the retracted position A1 (FIG. 23) towards the advanced position A2 (FIG. 26), the number of buffer mechanisms 53 acting on the second receiving portion 33 becomes smaller.

Figure 23:
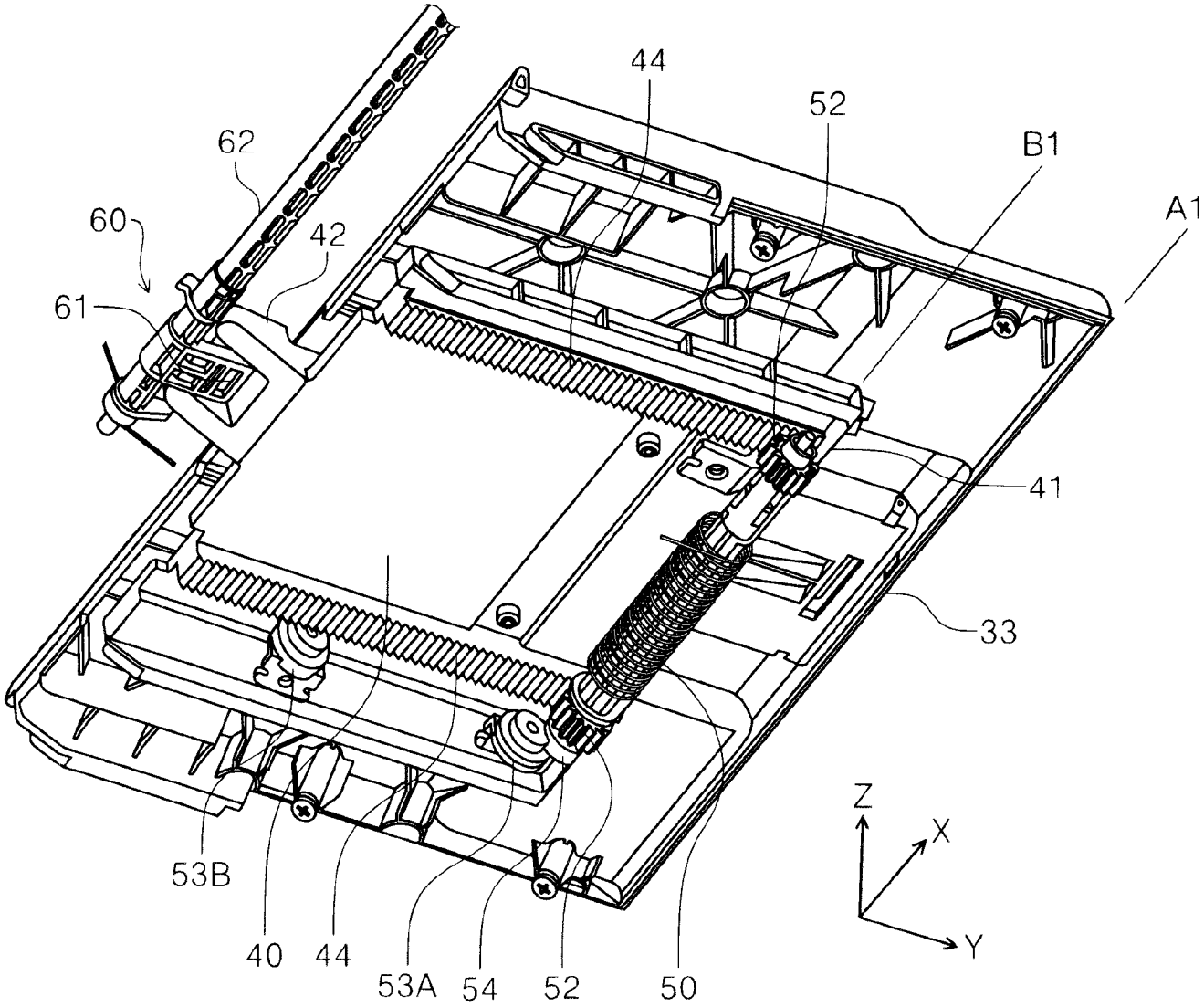
FIG. 23 is a diagram illustrating a first modification of a buffer mechanism and is a perspective view illustrating a state in which the moving member is restricted by the restricting member.

As illustrated in FIG. 23, the first modification includes two buffer mechanisms, namely, a buffer mechanism 53A and a buffer mechanism 53B. The buffer mechanism 53A is a gear damper that is coupled to an outer gear 54 rotating coaxially with the gear 52 and that reduces the rotating speed of the gear 52. The buffer mechanism 53B is a gear damper that is coupled to the rack portion 44 on the −X direction side and that reduces the moving speed of the moving member 40. The buffer mechanism 53B is provided in the lower unit 32*b* so as to be spaced apart from the buffer mechanism 53A in the Y-axis direction.

When force is applied to the buffer mechanism 53A and the buffer mechanism 53B in the rotation direction due to the moving member 40 moving in the +Y direction, the buffer mechanism 53A and the buffer mechanism 53B are configured to rotate while generating a predetermined torque countering the force in the rotation direction.

In a state in which the second receiving portion 33 has advanced in the +Y direction from the retracted position A1 (FIG. 23), and as illustrated in FIG. 24, in which the buffer mechanism 53A is coupled to the gear 52 and the buffer mechanism 53B is coupled to the rack portion 44, the second receiving portion 33 receives the buffer action of both the buffer mechanism 53A and the buffer mechanism 53B.

When the second receiving portion 33 further advances in the +Y direction, as illustrated in FIG. 25, the buffer mechanism 53B is separated from the rack portion 44. Accordingly, after the above, the buffer action of the buffer mechanism 53B does not act on the second receiving portion 33. The second receiving portion 33 advances from the position in FIG. 25 to the advanced position A2 illustrated in FIG. 26 while receiving only the buffer action of the buffer mechanism 53A.

The increase and decrease in the number of buffer mechanisms 53 correspond to the magnitude of the buffer action. In other words, when the number of buffer mechanisms 53 decreases, the buffer action that the second receiving portion 33 receives becomes smaller.

A configuration can be provided in which the buffer action becomes smaller while the second receiving portion 33 moves in the +Y direction or the advancing direction with a configuration of the first modification in which the number of buffer mechanisms 53 acting on the second receiving portion 33 decreases as the second receiving portion 33 moves from the retracted position A1 towards the advanced position A2.

In other words, a large buffer action can be provided to the second receiving portion 33 with the two buffer mechanisms, namely, the buffer mechanism 53A and the buffer mechanism 53B, immediately after the restricting state (FIG. 23) has been switched to the non-restricting state (FIG. 24) with the restricting member 60, which is when the pushing force of the pushing member 50 is large; accordingly, the jumping out of the second receiving portion 33 at high speed can be suppressed.

Furthermore, when the winding of the torsion coil spring serving as the pushing member 50 has been released and the pushing force of the pushing member 50 has become small, the buffer mechanism 53A alone acts on the movement of the second receiving portion 33; accordingly, the second receiving portion 33 can be moved to the advanced position A2 without excessively decelerating the second receiving portion 33.

Accordingly, the moving speed of the second receiving portion 33 from the retracted position A1 to the advanced position A2 can be made stable.

Not limited to two, three or more buffer mechanisms 53 can be provided. For example, a buffer mechanism (not shown) coupled to the rack portion 44 can be provided between the buffer mechanism 53A and the buffer mechanism 53B. With the above, the buffer action with the buffer mechanisms 53 can be reduced in a stepwise manner.

Referring next to FIG. 27, a description of the second modification will be given.

In the second modification, as the second receiving portion 33 moves from the retracted position A1 towards the advanced position A2, the number of buffer mechanisms 53 acting on the second receiving portion 33 becomes larger.

As illustrated in the left and right drawings in FIG. 27, the second modification includes two buffer mechanisms, namely, the buffer mechanism 53A and a buffer mechanism 53C. The buffer mechanism 53A has a configuration similar to that of the first modification. The buffer mechanism 53C is a gear damper that is coupled to the rack portion 44 on the −X direction side and that reduces the moving speed of the moving member 40. The buffer mechanism 53C is configured to switch between a state illustrated in the right drawing in FIG. 27 in which the buffer mechanism 53C is coupled to the rack portion 44, and a state illustrated in the left drawing in FIG. 27 in which the buffer mechanism 53C is not coupled to the rack portion 44. The buffer mechanism 53C is disposed at a position adjacent to the buffer mechanism 53A in the Y-axis direction, and is provided in the lower unit 32*b*.

When force is applied to the buffer mechanism 53C in the rotation direction by the moving member 40 moving in the +Y direction, the buffer mechanism 53C is also configured to rotate while generating a predetermined torque countering the force in the rotation direction.

In the second modification, the buffer mechanism 53C is not coupled to the rack portion 44 when the second receiving portion 33 advances in the +Y direction from the retracted position A1 (the left drawing in FIG. 27). Immediately after the second receiving portion 33 has started to advance in the +Y direction from the retracted position A1, the second receiving portion 33 receives the buffer action from the buffer mechanism 53A alone.

When the second receiving portion 33 advances to a predetermined position between the retracted position A1 and the advanced portion A2, the buffer mechanism 53C becomes coupled with the rack portion 44 and, after the above, the second receiving portion 33 receives the buffer action from both the buffer mechanism 53A and the buffer mechanism 53C and proceeds to the advanced position A2 illustrated in the right drawing in FIG. 27.

Switching between coupling and non-coupling between the buffer mechanism 53C and the rack portion 44 can be performed by, for example, a drive source such as a motor or a solenoid. For example, a tray position detection member that detects the position of the second receiving portion 33 can be provided, and the switching may be performed when the second receiving portion 33 has advanced to the predetermined position.

With the above configuration, the number of buffer mechanisms 53 that act on the second receiving portion 33 can be increased and the buffer action can be increased as the second receiving portion 33 moves from the retracted position A1 towards the advanced position A2.

By increasing the buffer action with the buffer mechanisms 53 as the second receiving portion 33 moves from the retracted position A1 towards the advanced position A2, the second receiving portion 33 can be moved at a fast speed by reducing the action of the buffer mechanisms 53 for some time after the second receiving portion 33 has started to move, and the action of the buffer mechanisms 53 can be increased when the second receiving portion 33 approaches the advanced position A2; accordingly, hitting sound and vibration generated by the second receiving portion 33 arriving at the advanced position A2 with momentum can be suppressed.

Referring next to FIG. 28, a description of the third modification will be given.

In the third modification, as the second receiving portion 33 moves from the retracted position A1 towards the advanced position A2, the number of buffer mechanisms 53 acting on the second receiving portion 33 increases after decreasing.

The buffer mechanism 53 of the third modification includes the buffer mechanism 53A and the buffer mechanism 53C similar to those in the second modification.

As illustrated in the left drawing in FIG. 28, in the third modification, when the second receiving portion 33 starts to advance in the +Y direction from the retracted position A1, the buffer mechanism 53C is in a state coupled to the rack portion 44.

When the second receiving portion 33 advances to a predetermined position between the retracted position A1 and the advanced position A2, the buffer mechanism 53C is brought to a non-coupled state with the rack portion 44 as illustrated in the right drawing in FIG. 28. After the above, the second receiving portion 33 advances while receiving only the buffer action of the buffer mechanism 53A.

Furthermore, while not illustrated, when the second receiving portion 33 advances further and is immediately before the advanced position A2, the buffer mechanism 53C is coupled to the rack portion 44 once again. Hereinafter, the second receiving portion 33 advances to the advanced position A2 while receiving the buffer action of both the buffer mechanism 53A and the buffer mechanism 53C.

In the third modification as well, switching between coupling and non-coupling between the buffer mechanism 53C and the rack portion 44 can be performed by, for example, a drive source such as a motor or a solenoid. A tray position detection member that detects the position of the second receiving portion 33 can be provided so that the switching can be performed when the second receiving portion 33 has advanced to the predetermined position.

With the above configuration, the number of buffer mechanisms 53 acting on the second receiving portion 33 as the second receiving portion 33 moves from the retracted position A1 towards the advanced position A2 can be increased after being decreased; accordingly, a configuration in which the buffer action, after temporarily becoming small, becomes large once more while the second receiving portion 33 moves from the retracted position A1 to the advanced position A2 can be provided.

In the third modification, immediately after the restricting state (the left drawing in FIG. 28) has been switched to the non-restricting state with the restricting member 60 and while in a state in which the pushing force of the pushing member 50 (the torsion coil spring) is large, the buffer action of the two buffer mechanisms, namely, the buffer mechanism 53A and the buffer mechanism 53C are exerted on the second receiving portion 33; accordingly, jumping out of the second receiving portion 33 at high speed can be suppressed.

On the other hand, when the winding of the torsion coil spring serving as the pushing member 50 has been released and the pushing force of the pushing member 50 has become small, the buffer mechanism 53A alone act on the second receiving portion 33; accordingly, the second receiving portion 33 can be moved towards the advanced position A2 without excessively reducing the speed of the second receiving portion 33.

Furthermore, since the action of the buffer mechanism 53A and the buffer mechanism 53C are both received once more by the second receiving portion 33 immediately before the second receiving portion 33 reaches the advanced position A2, the hitting sound and the vibration generated by the second receiving portion 33 reaching the advanced position A2 with momentum can be suppressed.

In the first to third modifications, the buffer mechanism 53B can be, for example, configured to be attached to the rack portion 44 in the +X direction.

Furthermore, in FIGS. 27 and 28, the buffer mechanism 53C in the second and third modifications are illustrated so as to be displaced in the X-axis direction to facilitate understanding of the non-coupled state with the rack portion 44; however, the buffer mechanism 53C can be displaced in the Z-axis direction to switch between the state in which the buffer mechanism 53C is coupled with the rack portion 44 and the state in which the buffer mechanism 53 C is not coupled with the rack portion 44.

Note that from a different viewpoint, the medium discharging apparatus 30 can be regarded as an apparatus in which the recording function has been removed from the printer 1. Alternatively, even when the medium discharging apparatus 30 has a recording function, when focusing on the viewpoint of discharging a medium, the printer 1 itself can be regarded as a medium discharging apparatus 30.

The printer has been described in the embodiment is an example of the medium processing apparatus; however, for example, the present disclosure can be applied, in a similar manner, to a scanner that performs an image reading process on a medium.

Furthermore, the present disclosure is not limited to the embodiment described above, and various modifications that are within the scope of the claims can be made. It goes without saying that such modifications are also included in the scope of the disclosure.

What is claimed is:

1. A medium discharging apparatus comprising:

a discharge portion that discharges a medium;

a medium receiving portion that receives the medium discharged by the discharge portion, the medium receiving portion including a first receiving portion, and a second receiving portion that is provided on the first receiving portion and that is configured to be displaced between a retracted position and an advanced position positioned downstream of the retracted position in a medium discharge direction, wherein the first receiving portion receives the medium discharged by the discharge portion before the discharged medium is received by the second receiving portion;

a moving member configured to move between a first position and a second position positioned downstream of the first position in the medium discharge direction, wherein the moving member pushes and moves the second receiving portion towards the advanced position as the moving member moves from the first position towards the second position and wherein the moving member is moved in the first position as the second receiving portion is displaced to the retracted position;

a pushing member that pushes the moving member towards the second position; and a restricting member configured to switch between a restricting state that restricts a movement of the moving member towards the second position while countering pushing force of the pushing member, and a non-restricting state that releases the restricting state.

2. The medium discharging apparatus according to claim 1, further comprising:

a medium length acquiring member that acquires a length of the medium discharged by the discharge portion, and a restricting member control unit that switches the restricting member to the non-restricting state when the length of the medium is equivalent to or larger than a predetermined length.

3. The medium discharging apparatus according to claim 1, wherein the moving member includes an abutting portion that abuts against an abutted portion provided in the second receiving portion when the moving member moves towards the second position.

4. The medium discharging apparatus according to claim 1, wherein the second receiving portion is configured to move downstream of the moving member in the medium discharge direction when the moving member is at the first position, and the moving member includes a contact portion that creates a frictional resistance with the second receiving portion.

5. The medium discharging apparatus according to claim 1, further comprising:

an apparatus body unit that includes the discharge portion and the medium receiving portion, wherein the medium receiving portion is configured to detach from the apparatus body unit.

6. The medium discharging apparatus according to claim 1, further comprising:

a buffer mechanism that reduces a moving speed of the second receiving portion moving from the retracted position to the advanced position by being pushed by the moving member.

7. The medium discharging apparatus according to claim 6, wherein a plurality of the buffer mechanisms arranged in a moving direction of the second receiving portion are provided, and a number of buffer mechanisms that acts on the second receiving portion changes as the second receiving portion moves from the retracted position towards the advanced position.

8. The medium discharging apparatus according to claim 7, wherein the number of buffer mechanisms that acts on the second receiving portion decreases as the second receiving portion moves from the retracted position towards the advanced position.

9. The medium discharging apparatus according to claim 7, wherein as the second receiving portion moves from the retracted position towards the advanced position, the number of buffer mechanisms that acts on the second receiving portion increases after decreasing.

10. The medium discharging apparatus according to claim 7, wherein the number of buffer mechanisms that acts on the second receiving portion increases as the second receiving portion moves from the retracted position towards the advanced position.

11. The medium discharging apparatus according to claim 1, wherein the restricting member is configured to switch between a first restricting state that restricts the moving member at the first position, and a second restricting state that restricts the moving member at a downstream position that is closer to the second position than the first position.

12. A medium processing apparatus comprising:

a processing portion that performs processing on a medium; and the medium discharging apparatus according to claim 1 that discharges the medium on which processing has been performed in the processing portion.

13. The medium processing apparatus according to claim 12, wherein the medium processing apparatus is a recording apparatus that includes a recording unit serving as the processing portion, the recording unit performing a recording process on the medium.

* * * * *